US010308027B2

(12) United States Patent
Nakamura

(10) Patent No.: US 10,308,027 B2
(45) Date of Patent: Jun. 4, 2019

(54) LIQUID EJECTING APPARATUS AND CLEANING APPARATUS

(71) Applicant: SEIKO EPSON CORPORATION, Tokyo (JP)

(72) Inventor: Chikashi Nakamura, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/837,771

(22) Filed: Dec. 11, 2017

(65) Prior Publication Data

US 2018/0178523 A1 Jun. 28, 2018

(30) Foreign Application Priority Data

Dec. 22, 2016 (JP) ..... 2016-249948

(51) Int. Cl.
*B41J 2/165* (2006.01)

(52) U.S. Cl.
CPC ..... *B41J 2/16532* (2013.01); *B41J 2/16517* (2013.01); *B41J 2/16535* (2013.01); *B41J 2002/1655* (2013.01)

(58) Field of Classification Search
None
See application file for complete search history.

(56) References Cited

U.S. PATENT DOCUMENTS

2005/0156995 A1* 7/2005 Nishino ..... B41J 2/16535 347/33
2012/0050403 A1 3/2012 Inoue
2013/0120495 A1 5/2013 Nakamura et al.
2014/0125734 A1 5/2014 Kobayashi
2014/0152740 A1 6/2014 Yoshino

FOREIGN PATENT DOCUMENTS

| | | |
|---|---|---|
| JP | 08-323999 | 12/1996 |
| JP | 2005-022251 | 1/2005 |
| JP | 2005-205631 | 8/2005 |
| JP | 2008-137266 | 6/2008 |
| JP | 2008-229962 | 10/2008 |
| JP | 2011-067985 | 4/2011 |
| JP | 2012-051184 | 3/2012 |
| JP | 4967470 B | 4/2012 |
| JP | 2014-069309 | 4/2014 |
| JP | 2014-091319 | 5/2014 |
| JP | 2014-108594 | 6/2014 |
| JP | 5899840 B | 3/2016 |

* cited by examiner

*Primary Examiner* — Matthew Luu
*Assistant Examiner* — Tracey M McMillion
(74) *Attorney, Agent, or Firm* — Workman Nydegger

(57) ABSTRACT

A liquid ejecting apparatus performs first contact of an absorption member with a nozzle surface in which nozzles for liquid ejection are arranged, and performs second contact of the absorption member with the nozzle surface after the first contact. Pressure applied to, of the nozzle surface, a nozzle neighborhood area (a nozzle peripheral area) including the nozzles due to contact of the absorption member in the first contact is lower than pressure applied to the nozzle neighborhood area (a nozzle peripheral area) due to contact of the absorption member in the second contact.

9 Claims, 13 Drawing Sheets

LIQUID EJECTING APPARATUS AND CLEANING APPARATUS

CROSS REFERENCES TO RELATED APPLICATIONS

The entire disclosure of Japanese Patent Application No. 2016-249948, filed Dec. 22, 2016 is expressly incorporated by reference herein.

BACKGROUND

1. Technical Field

The present invention relates to a liquid ejecting apparatus such as, for example, an ink-jet printer, and relates to a cleaning apparatus.

2. Related Art

As a kind of a liquid ejecting apparatus, an ink-jet printer that performs printing by ejecting liquid such as ink onto paper from nozzles arranged on a liquid ejecting head is known. Some of these printers are equipped with a liquid discharging head cleaner (cleaning apparatus) that wipes the discharging surface (nozzle surface in which nozzles are arranged) of a liquid discharging head (liquid ejecting head) with a wiping member (absorption member) to absorb liquid on the discharging surface (for example, see JP-A-2011-067985).

Specifically, a liquid discharging head cleaner according to related art includes a first pressing roller and a second pressing roller that function as a pressing means (pressing section) for pressing a wiping member against, for contact, the discharging surface of a liquid discharging head. After the non-finish wiping of the entire discharging surface by an entire-width roller that is the first pressing roller, the finish wiping of the discharging surface is performed by a nozzle-surface roller that is the second pressing roller.

However, there are the following problems in a liquid discharging head cleaner (cleaning apparatus) according to related art. In a case where the discharging surface (nozzle surface) has a convex portion and a concave portion (level difference therebetween), if the force of pressing the absorption member (wiping member) against the discharging surface by the roller member is increased in order to increase the performance of wiping liquid on the discharging surface in non-finish wiping, the increased pressing force makes the discharging surface more susceptible to damage and resultant deterioration. Moreover, since the width of the nozzle-surface roller is less than that of the entire-width roller, the pressing force applied to, of the discharging surface, the nozzle peripheral area including the nozzles in finish wiping by the nozzle-surface roller is high, which makes the area especially susceptible to damage and resultant deterioration.

These problems and the like are not unique to ink-jet printers that perform printing by ejecting liquid ink from nozzles. These problems and the like are common to various liquid ejecting apparatuses equipped with a cleaning apparatus that wipes, by holding an absorption member in contact with a nozzle surface in which nozzles are arranged, liquid that is on the nozzle surface by means of the absorption member.

SUMMARY

An advantage of some aspects of the invention is to provide a liquid ejecting apparatus and a cleaning apparatus for achieving a reduction in the deterioration of a nozzle surface.

Solving means according to some aspects, and operational effects thereof, are described below.

A liquid ejecting apparatus according to an aspect comprises: a liquid ejecting head that ejects liquid from a plurality of nozzles arranged in a nozzle surface; an absorption member that is brought into contact with the nozzle surface and is able to absorb liquid that is on the nozzle surface; and a contacting section that performs a first contact of the absorption member with the nozzle surface and performs, after the first contact, a second contact of the absorption member with the nozzle surface by pressing the absorption member against the nozzle surface from an opposite side that is opposite of a side of contact with the nozzle surface, wherein pressure applied to, of the nozzle surface, a nozzle peripheral area including the nozzles due to contact of the absorption member in the first contact is lower than pressure applied to the nozzle peripheral area due to contact of the absorption member in the second contact.

Before the second contact, in which pressure for finish wiping is to be applied to the nozzle peripheral area, the first contact is performed, wherein pressure that is lower than pressure applied to the nozzle peripheral area in the second contact is applied to the nozzle peripheral area in the first contact. Therefore, the structure of the above aspect makes it possible to catch a foreign object and/or an inorganic substance in ink, thereby reducing the deterioration of the nozzle surface.

In the above liquid ejecting apparatus, preferably, the contacting section should include a first contacting section that performs the first contact by holding the absorption member in contact with the nozzle surface and a second contacting section that performs the second contact by holding the absorption member in contact with the nozzle surface.

With the preferred structure, by using the first contacting section, which is different from the second contacting section, it is possible to perform the first contact of applying pressure that is lower than pressure applied in the second contact.

In the above liquid ejecting apparatus, preferably, the first contacting section should have a concave portion that is recessed away from the absorption member at a portion corresponding to the nozzle peripheral area in comparison with a portion corresponding to an area other than the nozzle peripheral area.

The first contacting section having the preferred structure is suitable because it easily achieves a reduction in pressure applied to the nozzle peripheral area in the first contact.

In the above liquid ejecting apparatus, preferably, the pressure applied to the nozzle peripheral area of the nozzle surface due to the contact of the absorption member in the first contact should be lower than pressure applied to an area other than the nozzle peripheral area of the nozzle surface due to the contact of the absorption member in the first contact.

With the preferred structure, when the absorption member is in contact with the nozzle surface to absorb liquid, it is possible to absorb the liquid on the nozzle surface while suppressing the damage to the nozzle peripheral area.

In the above liquid ejecting apparatus, preferably, a coefficient of compressibility of a portion of the absorption member pressed against the nozzle peripheral area in the first contact should be smaller than a coefficient of compressibility of a portion of the absorption member pressed against the area other than the nozzle peripheral area in the first contact.

Since the coefficient of compressibility of the portion of the absorption member pressed against the nozzle peripheral area is smaller than the coefficient of compressibility of the portion of the absorption member pressed against the area other than the nozzle peripheral area, with the preferred structure, pressure is adjusted properly depending on a difference between the portions of the absorption member pressed against the nozzle surface. Therefore, it is possible to absorb the liquid on the nozzle surface while suppressing the damage to the nozzle peripheral area during the contact of the absorption member.

In the above liquid ejecting apparatus, preferably, in the first contact, the absorption member should be in contact with the nozzle surface without any contact with the nozzle peripheral area.

With the preferred structure, in the first contact, the absorption member is able to absorb liquid on the nozzle peripheral area or a liquid meniscus protruding from the nozzle by coming into contact with the liquid, without any contact with the nozzle peripheral area. Therefore, it is possible to absorb the liquid while suppressing the damage to the nozzle peripheral area.

In the above liquid ejecting apparatus, preferably, an area other than the nozzle peripheral area should be a raised surface that is higher in level than the nozzle peripheral area and should have lower liquid repellency than liquid repellency of the nozzle peripheral area.

Because of the wet-spreading of liquid on the raised surface, the liquid repellency of which is relatively low, with the preferred structure, the absorption member is able to absorb the liquid on the raised surface efficiently.

In the above liquid ejecting apparatus, preferably, the absorption member should be a belt-shaped member; and the belt-shaped member should be supplied from a supplying section to a second contact area where the second contact is performed, next from the second contact area to a first contact area where the first contact is performed, and next from the first contact area to a collecting section.

In the preferred structure, the common absorption member is used for the first contact and the second contact, resulting in efficiency in use of the absorption member.

In the above liquid ejecting apparatus, preferably, the absorption member should be supplied in such a way as to bring a contact portion that was in contact with the nozzle surface in the second contact to a position for contact with the nozzle surface in the first contact.

Since the contact region of the absorption member that was used for contact with the nozzle surface in the second contact is reused in the next first contact, the preferred structure makes it possible to reduce the amount of use of the absorption member.

A cleaning apparatus according to an aspect comprises: an absorption member that is brought into contact with a nozzle surface of a liquid ejecting head that ejects liquid from a plurality of nozzles arranged in the nozzle surface, and is able to absorb liquid that is on the nozzle surface; and a contacting section that performs a first contact of the absorption member with the nozzle surface and performs, after the first contact, a second contact of the absorption member with the nozzle surface by pressing the absorption member against the nozzle surface from an opposite side that is opposite of a side of contact with the nozzle surface, wherein pressure applied to, of the nozzle surface, a nozzle peripheral area including the nozzles due to contact of the absorption member in the first contact is lower than pressure applied to the nozzle peripheral area due to contact of the absorption member in the second contact.

Before the second contact, in which pressure for finish wiping is to be applied to the nozzle peripheral area, the first contact is performed, wherein pressure that is lower than pressure applied to the nozzle peripheral area in the second contact is applied to the nozzle peripheral area in the first contact. Therefore, the structure of the above aspect makes it possible to catch a foreign object and/or an inorganic substance in ink, thereby reducing the deterioration of the nozzle surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
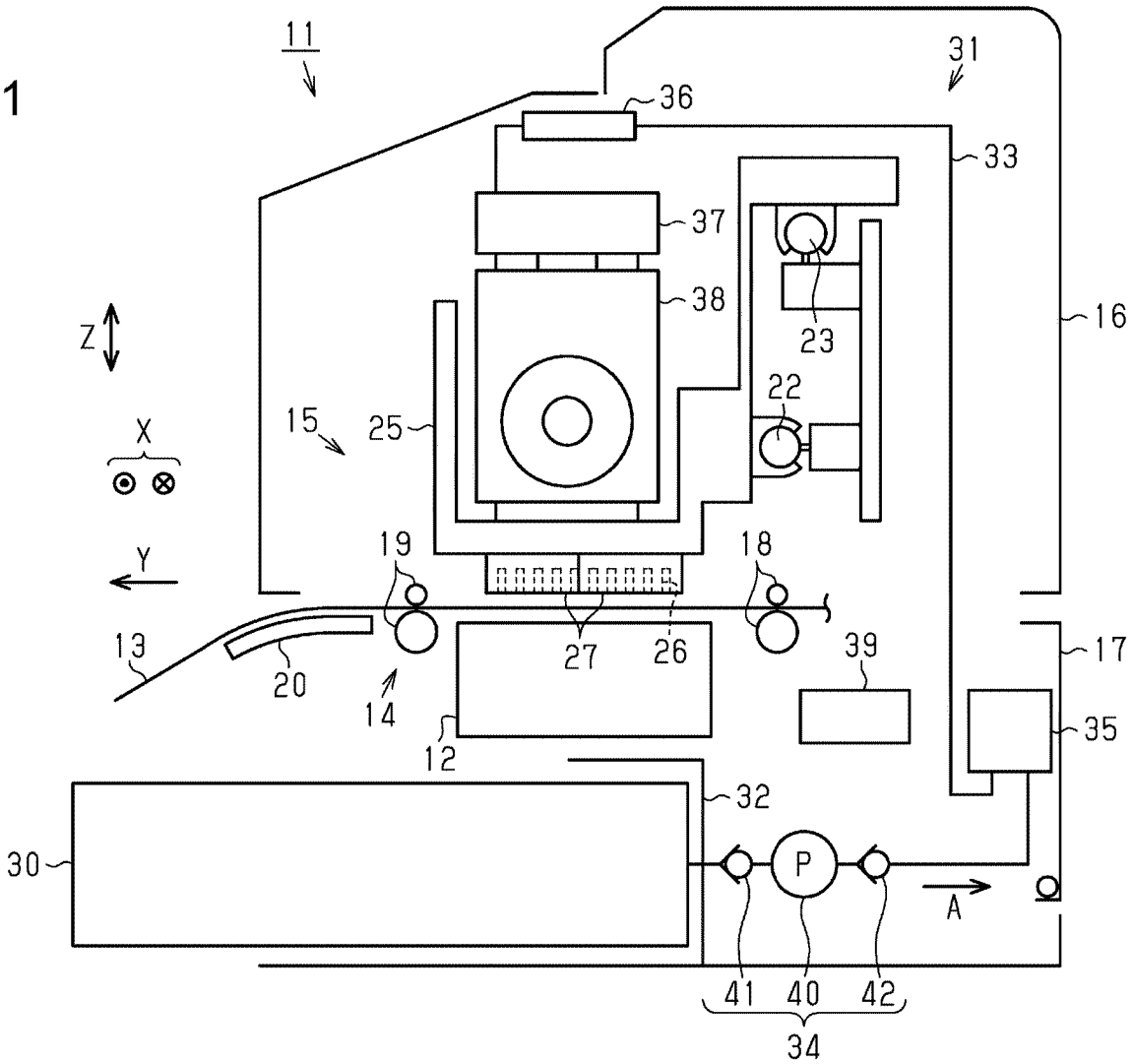
FIG. 1 is a schematic diagram that illustrates an exemplary overall structure of a printer according to an exemplary embodiment.

With reference to the accompanying drawings, a liquid ejecting apparatus according to an exemplary embodiment will now be explained. As illustrated in FIG. 1, a printer 11, which is an example of a liquid ejecting apparatus, is an ink-jet printer that includes a transportation unit 14 and a printing unit 15. The transportation unit 14 transports a recording target medium 13 such as paper supported on a supporting table 12 in a transportation direction Y along the surface of the supporting table 12. The printing unit 15 performs printing by ejecting ink, which is an example of a liquid, onto the recording target medium 13 that is transported.

The supporting table 12, the transportation unit 14, and the printing unit 15 are built in, and assembled to, a printer body 16 such as housing or a frame. The supporting table 12 of the printer 11 extends in the width direction of the recording target medium 13 (in the direction orthogonal to sheet face of FIG. 1). A cover 17, which can be opened and closed, is provided on the printer body 16.

The transportation unit 14 includes a pair of transportation rollers 18 and 19, which are provided respectively upstream and downstream of the supporting table 12 in the transportation direction Y, and a guide plate 20, which is provided downstream of the pair of transportation rollers 18 and 19 in the transportation direction Y and guides the recording target medium 13 while supporting it. Driven by a transportation motor (not illustrated), the pair of transportation rollers 18 and 19 of the transportation unit 14 rotate while nipping the recording target medium 13 therebetween. As a result of roller rotation, the recording target medium 13 is transported in the transportation direction Y along the surface of the supporting table 12 and then along the surface of the guide plate 20.

The printing unit 15 includes guide shafts 22 and 23 and a carriage 25. The guide shafts 22 and 23 are elongated in a scan direction X, which is the same as the width direction of the recording target medium 13 orthogonal to (intersecting with) the transportation direction Y of the recording target medium 13. The carriage 25 is able to travel in a reciprocating manner in the scan direction X while being guided by the guide shafts 22 and 23. Driven by a carriage motor 24 (see FIG. 2), the carriage 25 reciprocates in the scan direction X.

At least one liquid ejecting head 27 (two heads in the present embodiment), which has nozzles 26 for ink ejection, is mounted on the bottom of the carriage 25. That is, the liquid ejecting head 27 is mounted on the carriage 25 in a face-down orientation toward the supporting table 12 with a predetermined clearance therebetween in a vertical direction Z, and reciprocates in the scan direction X together with the carriage 25 driven by the carriage motor (see FIG. 2). The two liquid ejecting heads 27 of the present embodiment are located at a predetermined distance from each other in the scan direction X, with a predetermined positional shift from each other in the transportation direction Y.

A part of a supply mechanism 31 for supplying ink from an ink cartridge 30 to the liquid ejecting head 27 is fixed at the opposite side with respect to the direction of gravity, that is, partially over the carriage 25. The supply mechanism 31 causes ink to flow in a supply direction A from the ink cartridge 30, which is on the upstream side, to the liquid ejecting head 27, which is on the downstream side. The ink cartridge 30 and the supply mechanism 31 are provided as at least one pair for each kind of ink. In the present embodiment, four pairs are provided respectively for four kinds of ink.

The four ink cartridges 30 are detachably attached to respective (four in the present embodiment) attachment units 32 and contain ink of respective colors (kinds) that are different from one another. For example, the ink cartridges 30 contain cyan ink (C), magenta ink (M), yellow ink (Y), and black ink (K) respectively. Color printing, etc. on the recording target medium 13 is performed by ejecting, from the liquid ejecting head 27, ink supplied from each ink cartridge 30.

Each supply mechanism 31 includes a supply passage 33, through which ink is supplied from the ink cartridge 30 to the liquid ejecting head 27. The following components are provided on the supply passage 33 in order mentioned herein as viewed from the upstream side in the supply direction A: a supply pump 34 for sending ink, a filter unit 35 for trapping air bubbles and foreign particles in the ink, if any, a static mixer 36 for stirring the ink by causing a change in the flow of the ink through the supply passage 33, an ink reservoir 37, and a pressure adjustment unit 38 for adjusting ink pressure.

The supply pump 34 includes a diaphragm pump 40, which has a variable pump chamber capacity, an inlet valve 41, which is provided upstream of the diaphragm pump 40, and an outlet valve 42, which is provided downstream of the diaphragm pump 40. The inlet valve 41 and the outlet valve 42 constitute a one-way valve that allows ink to flow toward the downstream side and does not allow ink to flow toward the upstream side.

Therefore, the supply pump 34 takes in ink through the inlet valve 41 from the ink cartridge 30 when the capacity of the pump chamber of the diaphragm pump 40 increases, and discharges the ink through the outlet valve 42 toward the liquid ejecting head 27 when the capacity of the pump chamber of the diaphragm pump 40 decreases. The filter unit 35 is provided detachably on the supply passage 33 at a position corresponding to the position of the cover 17 of the printer body 16. A user is able to replace the filter unit 35 with new one after opening the cover 17.

The printer 11 includes a controller 39, which, for example, controls the rotation of the transportation motor (not illustrated) for driving the pair of transportation rollers 18 and 19, controls the driving of the carriage motor 24 (see FIG. 2) and the supply pump 34, etc., and controls the ejection of ink from each nozzle 26 of the liquid ejecting head 27. The liquid ejecting head 27 ejects ink from each nozzle 26 toward the recording target medium 13 transported over the supporting table 12 while reciprocating in the scan direction X together with the carriage 25 driven by the carriage motor 24, thereby performing printing.

Figure 2:
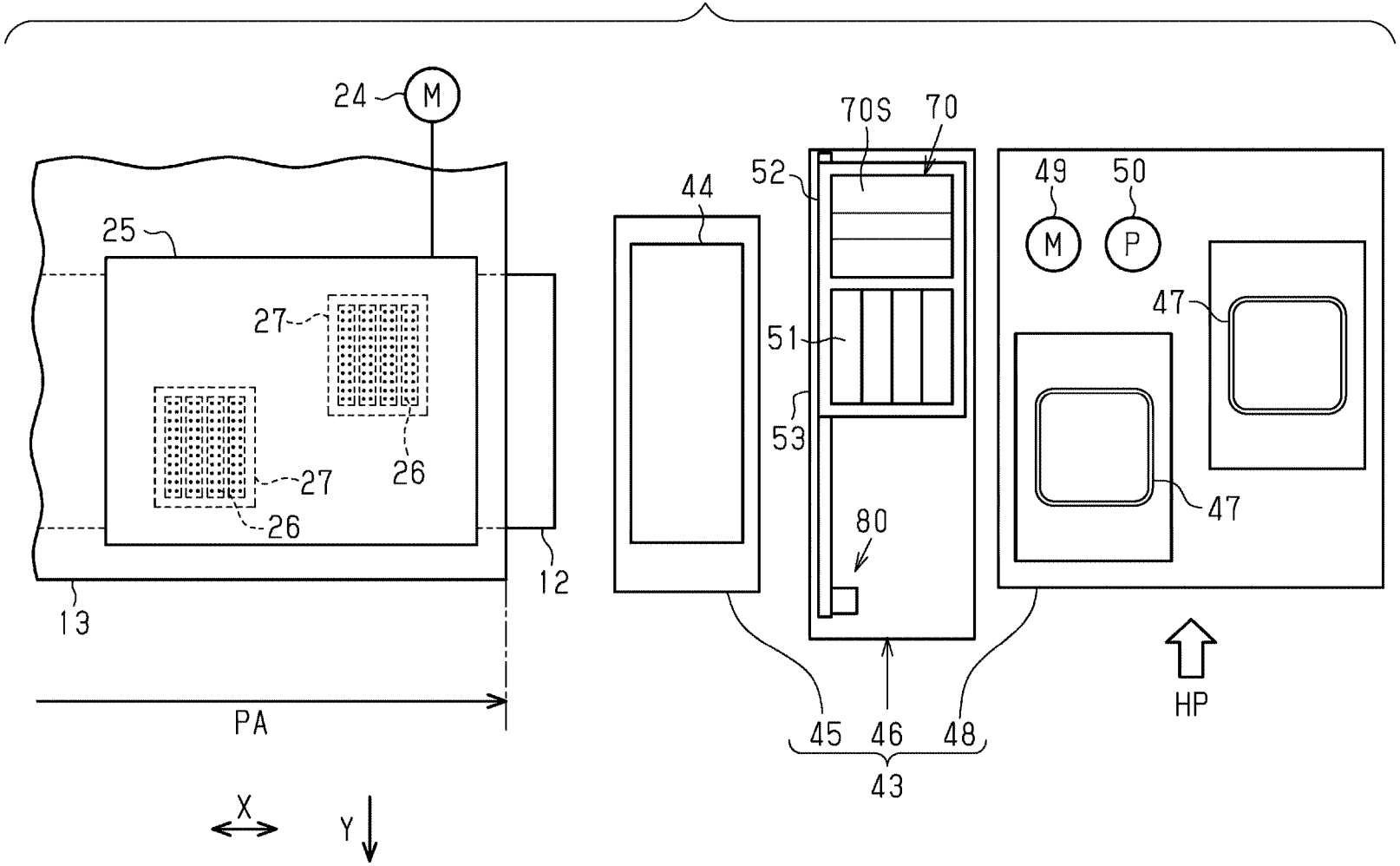
FIG. 2 is a schematic plan view of a positional relationship between a supporting table and a maintenance mechanism.

As illustrated in FIG. 2, a maintenance mechanism 43 for the maintenance of the liquid ejecting head(s) 27 is provided at a position adjacent to one end of the supporting table 12 in the scan direction X. In the present embodiment, the area where the liquid ejecting head 27 ejects ink onto the recording target medium 13 for the purpose of printing and where the recording target medium 13 is transported is referred to as transportation area PA. In the present case, the maintenance mechanism 43 is provided inside the scan area of the carriage 25 in the scan direction X and outside (in FIG. 2, to the right of) the transportation area PA.

The maintenance mechanism 43 includes a flushing unit 45, a wiper unit 46, and a cap unit 48. They are arranged in this order as viewed from the transportation area PA in the scan direction X, meaning that the flushing unit 45 is the closest to the transportation area PA. The flushing unit 45 includes an ink receiver 44. The wiper unit 46 is an example of a cleaning apparatus. The cap unit 48 includes two caps 47, each of which has a shape like an open-topped box.

The carriage 25 and the liquid ejecting head 27 are in a standby state at a home position HP when printing is not performed, when power is OFF, and the like. The home position HP is a location where the cap unit 48 is provided. That is, the liquid ejecting head 27 is able to move from the transportation area PA to the home position HP, and vice versa, in the scan direction X orthogonal to (intersecting with) the transportation direction Y.

When the two liquid ejecting heads 27 are located at the home position HP, the two liquid ejecting heads 27 and the two caps 47 face each other in the vertical direction. Driving by a capping motor 49, each of the two caps 47 moves vertically to a position of being in contact with the corresponding one of the two liquid ejecting heads 27 from a position of being distanced from the corresponding one of the two liquid ejecting heads 27, and vice versa.

Each cap 47 performs capping, which is an operation of coming into contact with the corresponding liquid ejecting head 27 in such a way as to enclose the plurality of nozzles 26 and form a closed space by working together with the corresponding liquid ejecting head 27, thereby preventing ink in the nozzles 26 from drying. Each liquid ejecting head 27 is capped by the corresponding cap 47 at the home position HP when, for example, printing is not performed.

One end of each suction tube (not illustrated) is connected to the corresponding cap 47 so that a suction force can be applied to the inside of the cap 47 via the tube by a suction pump 50. Each liquid ejecting head 27 is capped by the corresponding cap 47 at the home position HP, and the suction pump 50 is driven in this head-capped state. Therefore, a suction force is applied to the inside (closed space) of the cap 47, and, as a result, thickened ink, air bubbles, and the like inside the liquid ejecting head 27 are sucked out into the cap 47. This is called as head cleaning. The operation of the capping motor 49 and the suction pump 50 is controlled by the controller 39 (see FIG. 1).

The wiper unit 46 includes a wiper cassette 70 and a cassette holder 52, to which the wiper cassette 70 is attached. The wiper cassette 70 is provided with a cloth sheet 70S and is configured to wipe, for cleaning, the liquid ejecting head 27 by using the cloth sheet 70S. The cloth sheet 70S is an example of an absorption member that is capable of absorbing liquid such as ink. In the present embodiment, the wiper unit 46 includes an ink receiver cassette 51 for receiving ink ejected from the liquid ejecting head 27 when the wiping of the liquid ejecting head 27 by the wiper cassette 70 is to be performed. The ink receiver cassette 51 is attached to the cassette holder 52 at an attachment position downstream of the wiper cassette 70 in the transportation direction Y. The wiper unit 46 further includes a guide frame 53 and a holder driver 80. The guide frame 53 is configured to guide the two X-directional sides (scan-directional sides) of the movable cassette holder 52 to which the wiper cassette 70 and the ink receiver cassette 51 are attached. The holder driver 80 is provided on the guide frame 53 and causes the cassette holder 52 to reciprocate in the transportation direction Y. The guide frame 53 is fixed to the printer body 16.

When so-called flushing is performed, the liquid receiver 44 of the flushing unit 45 receives ejected (discharged) ink. Flushing is an operation of ejecting an ink droplet from each nozzle 26 for the purpose of prevention or troubleshooting of the clogging of the nozzle 26, not for the purpose of printing. Regarding the position of the flushing unit 45, the liquid receiver 44 is designed to be located under the left one of the two liquid ejecting heads 27 illustrated in FIG. 2 when the right one of the two liquid ejecting heads 27 illustrated in FIG. 2 is positioned over the wiper unit 46 (ink receiver cassette 51).

Figure 3:
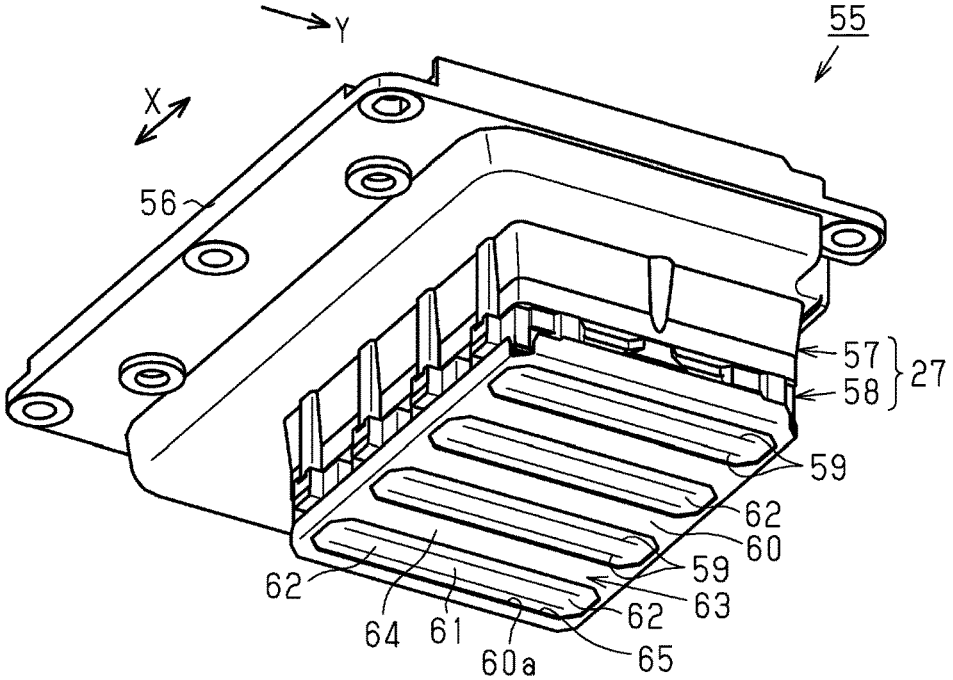
FIG. 3 is a perspective view of a head unit.

As illustrated in FIG. 3, a head unit 55 is designed to be mounted on the gravitation-directional face, that is, the bottom, of the carriage 25, and includes a bracket portion 56, which is to be mounted onto the carriage 25, and the liquid ejecting head 27, which has a shape like a rectangular parallelepiped protruding downward from the bracket portion 56. The liquid ejecting head 27 includes a flow passage forming portion 57, which has a shape like a rectangular parallelepiped protruding downward from the bracket portion 56 as mentioned herein, and a head body 58, which has a shape like a rectangular plate and is fixed to the bottom of the flow passage forming portion 57. The bottom face of the head body 58 illustrated in FIG. 3 has a plurality of nozzle lines 59 (for example, eight lines).

Figure 4:
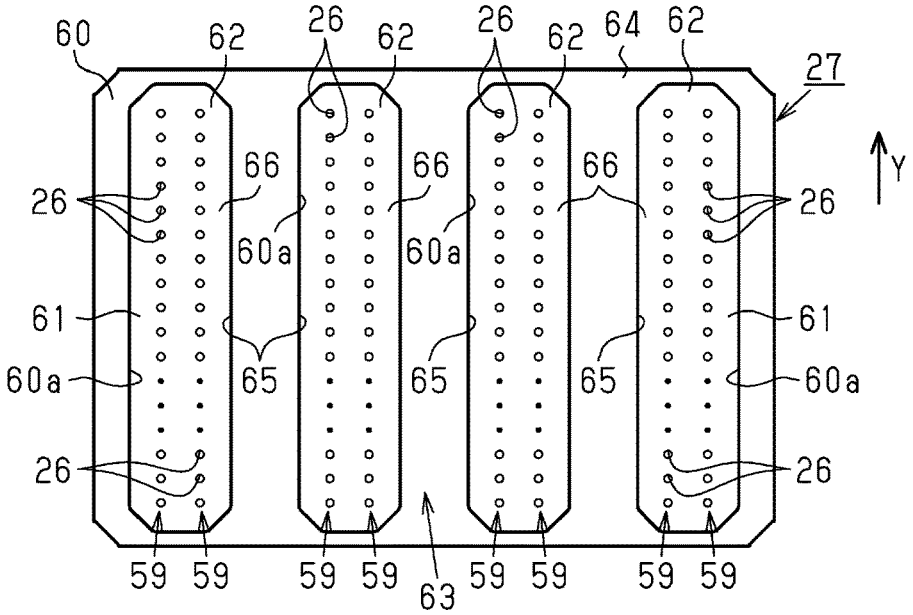
FIG. 4 is a schematic plan view of a nozzle surface.

A cover member 60, which is a plate-like member that has a plurality of windows 60*a* (for example, four windows) as its through holes, is fixed to the bottom face of the head body 58 in such a way as to cover a part of a nozzle-opening face 61 (in the present example, bottom face), which has orifices of the nozzles 26 constituting the nozzle lines 59 (see FIG. 4). A predetermined number of lines among the plurality of nozzle lines 59 are exposed through each one through-hole window 60*a* (for example, two lines each). Needless to say, the through-hole window 60*a* may be provided for each one of the plurality of nozzle lines 59.

In the present embodiment, of the nozzle-opening face 61, the area exposed through each through-hole window 60*a* is defined as nozzle neighborhood area 62 (nozzle peripheral area 62), inclusive of the nozzles 26. That is, the nozzle-opening face 61, which has orifices of the nozzles 26 of the liquid ejecting head 27, is partially covered by the cover member 60, which has the through-hole windows 60*a* each exposing a part that is defined as the corresponding nozzle neighborhood area 62 and is in the neighborhood of the orifices of the nozzles 26. The nozzle "neighborhood" area 62 (the nozzle "peripheral" area 62) is inclusive of the orifices of the nozzles 26 themselves (see FIG. 4).

Figure 5:
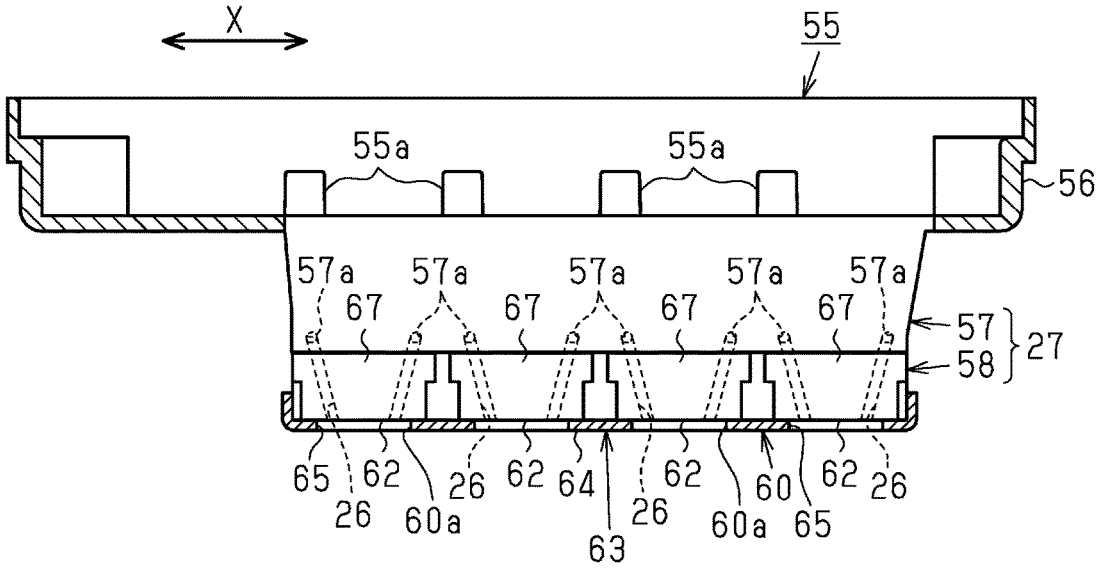
FIG. 5 is a schematic cross-sectional view of the head unit.

As illustrated in FIGS. 4 and 5, the cover member 60 is fixed to the liquid ejecting head 27 by means of a fixing structure such as fastening, etc. in such a state that the nozzle-opening face 61 is covered except for each nozzle neighborhood area 62 exposed through the corresponding through-hole window 60*a*. The entire bottom of the liquid ejecting head 27 with respect to the direction of gravity is a nozzle surface 63 that is the target of wiping by the wiper unit 46. That is, the nozzle surface 63 includes the nozzle neighborhood area(s) 62 (i.e., the area inside each through-hole window 60*a*) and a nozzle non-neighborhood area (a nozzle non-peripheral area) that is other than the nozzle neighborhood area 62, wherein the nozzle non-neighborhood area is the area of a raised surface 64, which is slightly higher in level (i.e., convex-structured) than the nozzle neighborhood area 62 by an amount substantially equal to the thickness of the cover member 60 (in the present example, 0.1 mm).

Therefore, there is a level difference 65 of 0.1 mm between the nozzle neighborhood area 62 and the raised surface 64 (nozzle non-neighborhood area). That is, the nozzle surface 63 has a partially-concave-and-partially-convex structure, meaning that the part corresponding to the nozzle neighborhood area 62 is its concave part and that the part corresponding to the raised surface 64 is its convex part. The cover member 60 is made of, for example, metal (e.g., stainless steel).

As illustrated in FIG. 4, the nozzle line 59 is made up of many nozzles 26 (for example, one hundred eighty nozzles or three hundred sixty nozzles) that are arranged at a constant pitch in the transportation direction Y. Each nozzle line 59 ejects ink of one color corresponding to the ink color of the ink cartridge 30 (see FIG. 1). Needless to say, the colors of ink ejected are not limited to the CMYK four colors. Ink of different colors, for example, light magenta, light cyan, light yellow, gray, orange, white, and the like may be ejected. The number of colors used by the liquid ejecting head 27 is not limited to the CMYK four colors. For example, it may be CMY three colors, black only, or the like. The plurality of nozzle lines 59 may include a non-used nozzle line(s) from which no ink is ejected.

In the present embodiment, liquid-repellent treatment (ink-repellent treatment) for making it easier to repel ink is applied to the nozzle-opening face 61 to form a liquid-repellent film 66 (ink-repellent film) thereon. On the other hand, an example of ink used in the present embodiment is pigment ink. In pigment ink, many pigment particles are dispersed in a liquid that is used as its dispersion medium. An organic pigment having an average particle diameter of 100 nm is used for cyan, magenta, and yellow, whereas carbon black (inorganic pigment) having an average particle diameter of 120 nm is used for black.

Pigment ink in the present example is water-based ink. Accordingly, many pigment particles are dispersed in water that is used as its dispersion medium. Therefore, in the present example, the liquid-repellent film 66 is a water-repellent film that has a function of repelling water-based ink. For example, the liquid-repellent film 66 may include a thin-film ground layer whose main ingredient is polyorganosiloxane containing an alkyl group and a liquid-repellent film layer made of metalalkoxide having a long chain polymeric matrix containing fluorine. The liquid-repellent film 66 wears away gradually due to abrasion through the processes of repetitive wiping of the nozzle-opening face 61. If the degree of wear of the liquid-repellent film 66 exceeds a predetermined level, its liquid repellency decreases. The liquid-repellent film 66 may be a liquid-repellent coating film or a liquid-repellent monomolecular film. A film thickness and a liquid-repellent treatment method may be selected arbitrarily.

If the liquid repellency of the liquid-repellent film 66 decreases, the wetting angle (contact angle) of a liquid such as ink mist on the nozzle neighborhood area 62 decreases. Therefore, ink mist particles on the nozzle neighborhood area 62 tend to wet-spread and grow into one ink droplet (adhesion ink) that is comparatively large. Therefore, adhesion ink formed in this way could exist near the nozzle 26; in some cases, the orifice of the nozzle 26 becomes closed by the ink, and/or the ink flows into the nozzle 26.

For example, if an ink droplet is ejected from a nozzle 26 in a state in which adhesion ink exists near this nozzle 26, the contact of the ejected ink droplet with the adhesion ink could happen. In such a case, the contact induces a non-straight traveling of the ejected ink droplet in the air. Such a non-straight traveling of the ejected ink droplet in the air causes a deviation in the landing position of the ink droplet onto the recording target medium 13 (i.e., print dot forming position) from the targeted landing position, resulting in poor print quality. For this reason, the wear of the liquid-repellent film 66 due to wiping damage needs to be minimized.

On the other hand, the cover member 60 is manufactured by machine-pressing a metal plate into a predetermined shape. The surface of the cover member 60 is not treated to be liquid repellent. For this reason, the liquid repellency of the raised surface 64 (nozzle non-neighborhood area) is lower than that of the nozzle neighborhood area 62. That is, the wetting angle of ink on the raised surface 64 is smaller than the wetting angle of ink on the nozzle neighborhood area 62.

As illustrated in FIG. 5, the liquid ejecting head 27 includes a plurality of recording heads 67 (unit heads) (four heads in the present embodiment) that are arranged in a line at a constant pitch in the scan direction X. The periphery of the nozzle-opening face 61 that is the bottom face of each recording head 67 is covered by the cover member 60, and each nozzle neighborhood area 62 including two lines of nozzles 26 is exposed through the corresponding through-hole window 60*a* of the cover member 60.

Each nozzle 26 is in communication with the corresponding ink flow passage 57*a* formed inside the flow passage forming portion 57. There is a plurality of supply tubes 55*a* protruding upward from the top of the flow passage forming portion 57. The ink flow passages 57*a* are in communication with the supply tube 55*a* via flow passages not illustrated. Each supply tube 55*a* is in communication with, via a flow passage not illustrated, the supply port of the corresponding pressure adjustment unit 38 mounted on the carriage 25 (see FIG. 1).

Therefore, from each pressure adjustment unit 38 (see FIG. 1), ink of the corresponding color is supplied to the nozzles 26 of the corresponding recording head 67 via the supply tube 55*a* and the ink flow passages 57*a*, etc. The liquid ejecting head 27 may have a single-head structure with three or more nozzle lines.

Next, the structure of the wiper unit 46 will now be explained.

Figure 6:
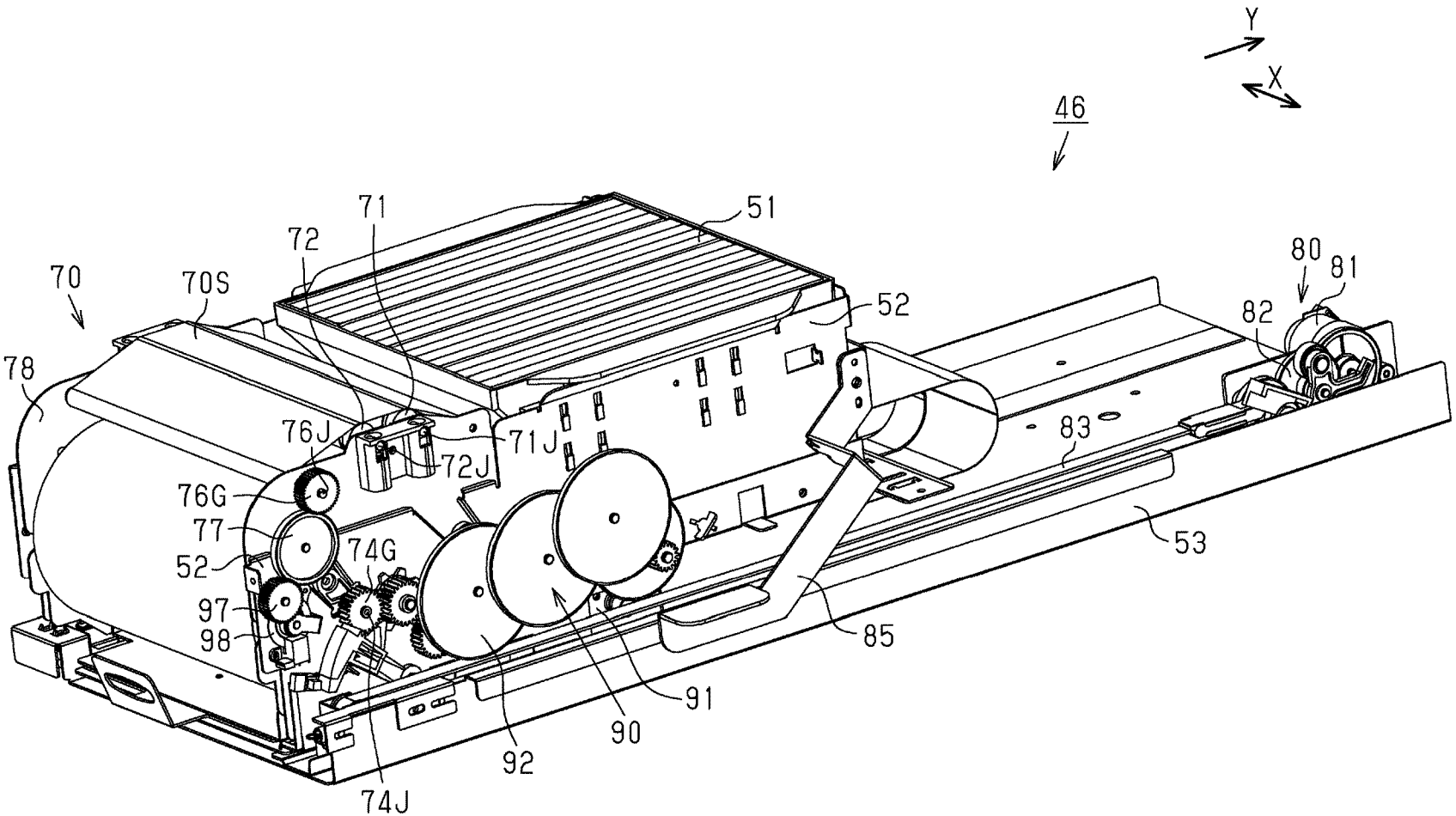
FIG. 6 is a perspective view of a wiper unit.
Figure 7:
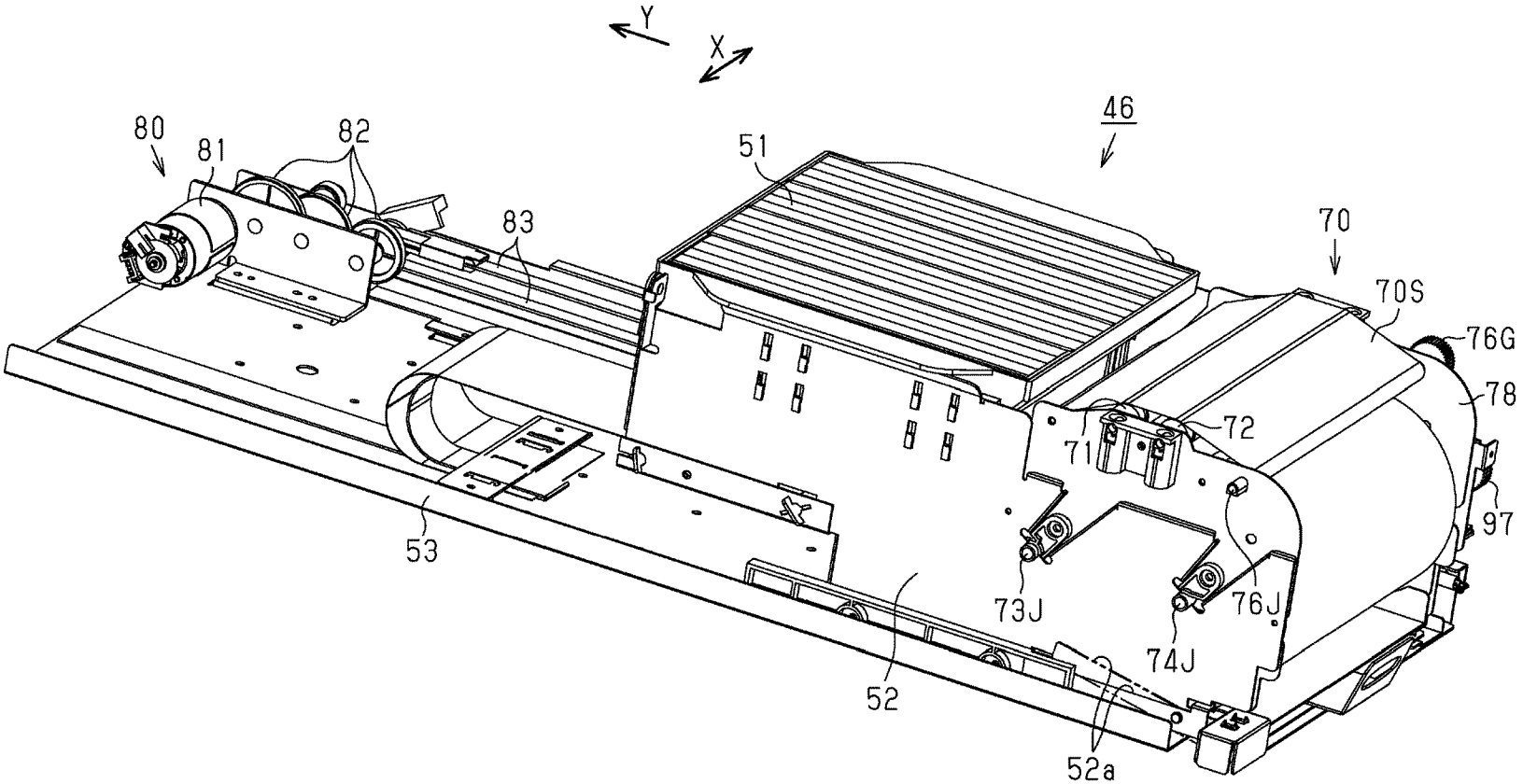
FIG. 7 is a perspective view of the wiper unit, taken from an opposite side in relation to FIG. 6.

As illustrated in FIGS. 6 and 7, the holder driver 80, which includes an electric motor 81 serving as a power source and a power transmission mechanism 82 for transmitting the power of the electric motor 81 to the cassette holder 52 via a belt 83, is provided on the guide frame 53, which is fixed to the printer body 16. Due to rotation of the electric motor 81, the cassette holder 52 is driven by the holder driver 80 to reciprocate in the transportation direction Y while being guided by the guide frame 53 at its two X-directional sides (scan-directional sides).

For example, the rotation of the electric motor 81 in the forward direction causes "going" movement from the state illustrated in FIG. 6 toward the downstream side in the transportation direction Y (rightward movement in FIG. 6) in the wiper unit 46. The going movement stops at a predetermined position when the rotation of the electric motor 81 stops. After the stop, next, the electric motor 81 is driven in the reverse direction. The reverse rotation causes "coming-back" movement for returning the cassette holder 52 to the original position illustrated in FIG. 6 toward the upstream side in the transportation direction Y (leftward movement in FIG. 6). As indicated by the dot-dot-dash line and the solid line in FIG. 7, the state of return of the cassette holder 52 to the original position is detected on the basis of a change in the position of a pivot lever 52*a* provided on the cassette holder 52.

On one side of the cassette holder 52 in the scan direction X, a power transmission mechanism 90, which includes an electric motor 91 and a gear train 92, is provided. The gear train 92 is made up of a plurality of spur gears for transmitting the rotation of the electric motor 91. When the electric motor 91 rotates, the rotation is transmitted by these gears of the power transmission mechanism 90 to the wiper cassette 70 attached to the cassette holder 52.

Figure 9:
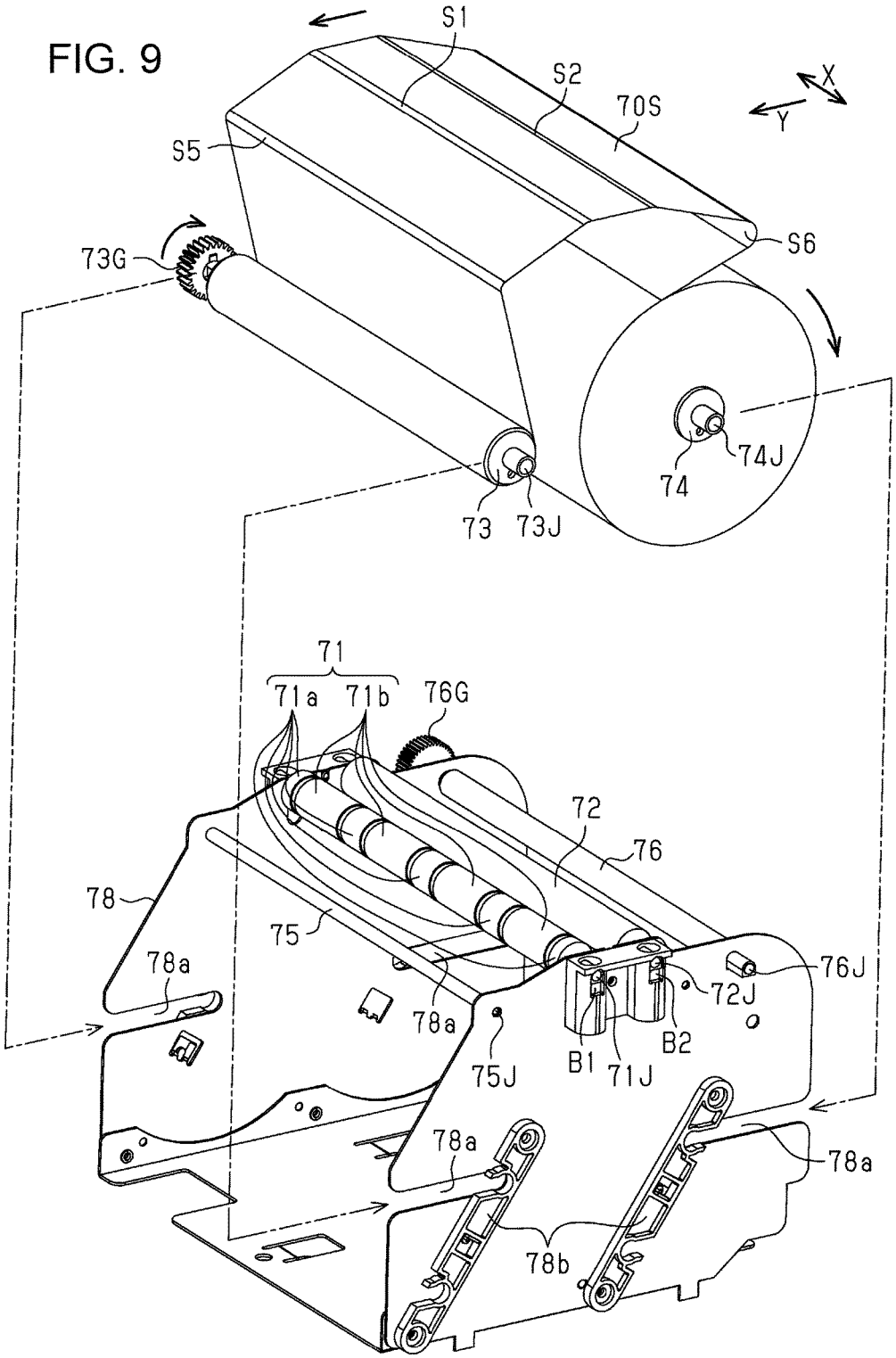
FIG. 9 is an exploded perspective diagram that illustrates an exemplary structure of a wiper cassette.

In the present embodiment, the wiper cassette 70 includes a cloth sheet 70S, an unreeling roller 74 (see FIG. 9), and a reeling roller 73 (see FIG. 9). The cloth sheet 70S is an example of a belt-shaped member that has a predetermined length and is provided in the form of a roll on the unreeling roller 74. The reeling roller 73 is configured to take up the cloth sheet 70S unreeled out of the roll. A gear 74G, which is fixed to a roller shaft end 74J of the unreeling roller 74, and a gear 73G, which is fixed to a roller shaft end 73J of the reeling roller 73 (see FIG. 9), rotate by receiving the transmitted power of rotation of the electric motor 91. Due to rotation of these gears, the cloth sheet 70S is reeled onto the reeling roller 73 by a predetermined length.

A rotatable gear 97 and a rotary encoder 98 configured to rotate due to rotation of the gear 97 are provided on the cassette holder 52. The wiper cassette 70 includes a rotation roller 76 (see FIG. 9), which rotates due to reeling of the cloth sheet 70S. A gear 76G is fixed to a roller shaft end 76J of the rotation roller 76. The gear 76G is in meshing engagement with a gear 77, which is also provided on the wiper cassette 70 and is in meshing engagement with a gear 97. Therefore, in the power transmission mechanism 90 of the cassette holder 52, the rotation of the electric motor 91 is controlled in such a way as to reel the cloth sheet 70S by a predetermined length using an output signal of the rotary encoder 98.

The wiper cassette 70 includes a first roller 71 and a second roller 72 for holding the cloth sheet 70S in contact with the nozzle surface 63 (see FIG. 4) of the liquid ejecting head 27 by pressing the cloth sheet 70S against the nozzle surface 63 from an opposite side that is opposite of a side of contact with the nozzle surface 63 when the nozzle surface 63 is wiped. The wiper cassette 70 includes a cassette frame 78. Roller shaft ends 71J of the first roller 71 and roller shaft ends 72J of the second roller 72 are rotatably supported by the cassette frame 78.

Figure 8:
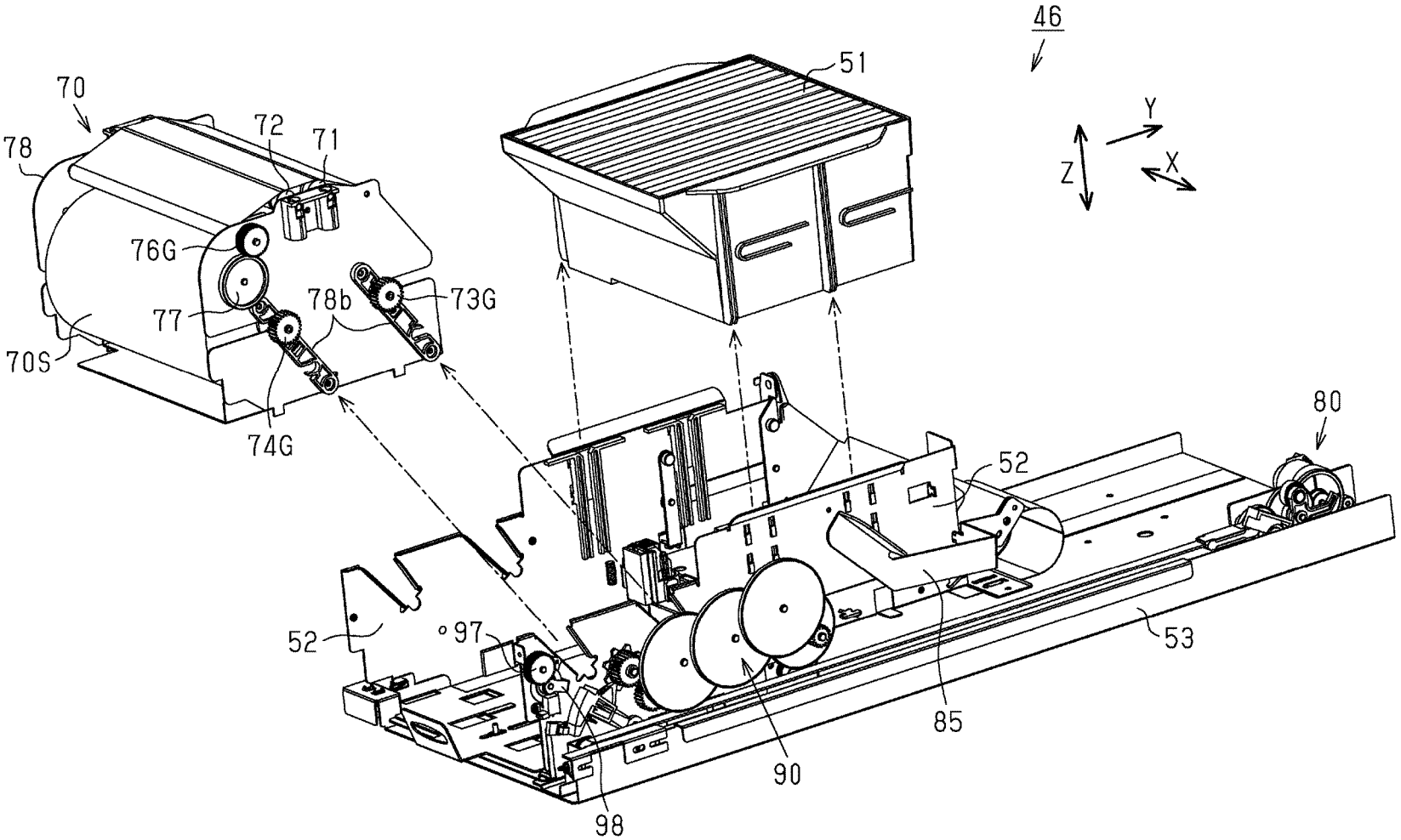
FIG. 8 is an exploded perspective diagram that illustrates an exemplary structure of the wiper unit.

As illustrated in FIG. 8, in the wiper unit 46 of the present embodiment, the wiper cassette 70 and the ink receiver cassette 51 are detachably attached to the cassette holder 52. Specifically, each of the two sidewalls of the cassette holder 52 in the scan direction X has two oblique slits that are inclined with respect to the vertical direction Z. The wiper cassette 70 is detached from the cassette holder 52 by disengaging convex parts 78*b* provided on the cassette frame 78 obliquely upward from the slits, and is attached to the cassette holder 52 by engaging the convex parts 78*b* obliquely downward with the slits. The ink receiver cassette 51 is detached from the cassette holder 52 by being pulled out upward in the vertical direction Z, and is attached to the cassette holder 52 by being pushed in downward in the vertical direction Z. The ink receiver cassette 51 can be pulled out of the cassette holder 52 by raising a lever 85, which is provided on the cassette holder 52 and is pivotable.

Next, the structure of the wiper cassette 70 will now be explained.

As illustrated in FIG. 9, the wiper cassette 70 includes a cassette frame 78, a first roller 71, a second roller 72, a rotation roller 75, and a rotation roller 76. The cassette frame 78 has two sidewalls at the respective sides in the scan direction X. The roller shaft ends 71J of the first roller 71, the roller shaft ends 72J of the second roller 72, the roller shaft ends 75J of the rotation roller 75, and the roller shaft ends 76J of the rotation roller 76 are rotatably supported by the two sidewalls of the cassette frame 78. The roller shaft ends 73J of the reeling roller 73 and the roller shaft ends 74J of the unreeling roller 74 are inserted into slits 78*a* of the two sidewalls of the cassette frame 78. The cloth sheet 70S of the wiper cassette 70 is set to have a shape that is determined by contact with each of the rollers 76, 72, 71, and 75 as illustrated in the upper part of FIG. 9.

The unreeling roller 74 and the reeling roller 73, the shaft ends of which are in the slits 78*a* of the two sidewalls of the cassette frame 78, are rotatably supported at a predetermined distance from each other in the transportation direction Y in the internal space of the wiper cassette 70. A yet-to-be-used cloth sheet 70S is supported in the form of a roll on the unreeling roller 74. As indicated by an arrow in FIG. 9, the unreeling roller 74 rotates to unreel the cloth sheet 70S. As indicated by an arrow in FIG. 9, the reeling roller 73 rotates to reel the cloth sheet 70S used after having been unreeled from the unreeling roller 74, and supports the roll. Therefore, the unreeling roller 74 functions as an example of a supplying section that supplies the cloth sheet 70S as an example of a belt-shaped member, and the reeling roller 73 functions as an example of a collecting section that collects the cloth sheet 70S.

The rotation roller 76, the second roller 72, the first roller 71, and the rotation roller 75 are rotatably supported at respective top positions by the two sidewalls of the cassette frame 78. The unreeled part of the cloth sheet 70S going from the unreeling roller 74 toward the reeling roller 73 is wrapped on the circumferential surface of each of the rollers 76, 72, 71, and 75 in this order from the outside. Of the cloth sheet 70S, the part that is in contact with the first roller 71 is defined as a first wrapped-on region S1, and the part that is in contact with the second roller 72 is defined as a second wrapped-on region S2. Similarly, the part that is in contact with the rotation roller 75 is defined as another wrapped-on region S5, and the part that is in contact with the rotation roller 76 is defined as another wrapped-on region S6. The cloth sheet 70S supported on the roller surface as described above is tensioned between the unreeling roller 74 and the reeling roller 73 of the wiper cassette 70.

Among the rollers on which the cloth sheet 70S is wrapped, the first roller 71 is in a state of pressing the first wrapped-on region S1 of the cloth sheet 70S upward because the roller shaft ends 71J of the first roller 71 are urged upward by compression springs B1. The second roller 72 is in a state of pressing the second wrapped-on region S2 of the cloth sheet 70S upward because the roller shaft ends 72J of the second roller 72 are urged upward by compression springs B2. In the present embodiment, the urging force (compression force) of each of the compression springs B1 is substantially equal to the urging force (compression force) of each of the compression springs B2.

Accordingly, the first roller 71 is configured to be able to hold at least a part of the first wrapped-on region S1 of the cloth sheet 70S in contact with the nozzle surface 63 by pressing the cloth sheet 70S against the nozzle surface 63 from, of the cloth sheet 70S, an opposite side that is opposite of a side of contact with the nozzle surface 63. The first roller 71 functions as an example of a contacting section for contact of the cloth sheet 70S with the nozzle surface 63. The second roller 72 is configured to be able to hold at least a part of the second wrapped-on region S2 of the cloth sheet 70S in contact with the nozzle surface 63 by pressing the cloth sheet 70S against the nozzle surface 63 from, of the cloth sheet 70S, an opposite side that is opposite of a side of contact with the nozzle surface 63. The second roller 72 also functions as an example of a contacting section for contact of the cloth sheet 70S with the nozzle surface 63.

The width of the cloth sheet 70S of the present embodiment in the scan direction X is slightly greater than the width of the nozzle surface 63 of the liquid ejecting head 27 in the scan direction X. Therefore, it is possible to wipe the entire area of the nozzle surface 63 with the cloth sheet 70S. The cloth sheet 70S of the present embodiment has a thickness of 0.34 to 0.41 mm. The cloth sheet 70S of the present embodiment is capable of absorbing and retaining 350% of a liquid in terms of weight ratio (ink and cleaning liquid).

In the present embodiment, the outer circumferential surface of the first roller 71 is a partially-concave-and-partially-convex surface, which has a level difference. Specifically, the first roller 71 includes a plurality of annular smaller-diameter sections 71*b*, which are arranged at equal spaces in an axial direction and constitute an example of a concave portion that is recessed away from the cloth sheet 70S, and a plurality of annular larger-diameter sections 71*a*, some of which are arranged between the smaller-diameter sections 71*b* and the others of which are arranged near the two ends of the shaft. Each of the larger-diameter sections 71*a* has a larger outside diameter than that of each of the smaller-diameter sections 71*b*. In the present embodiment, the first roller 71 includes five larger-diameter sections 71*a* and four smaller-diameter sections 71*b*, and the level difference between the outer circumferential surface of each of the larger-diameter sections 71*a* and the outer circumferential surface of each of the smaller-diameter sections 71*b* (the height of steps existing along the roller axis direction in the outer circumferential surface of the first roller 71) is 0.6±0.1 mm.

The first roller 71 is made of a hard material, for example, metal or hard synthetic resin. The larger-diameter sections 71*a* and the smaller-diameter sections 71*b* are arranged alternately and integrally without any clearance therebetween from the roller shaft end 71J to the roller shaft end 71J in the axial direction. Each of the larger-diameter sections 71*a* may be made of an elastic material, for example, rubber.

Unlike the first roller 71, the second roller 72 has a cylindrical outer circumferential surface without any level difference in the roller axis direction. That is, the second roller 72 has a shape like a round bar with a predetermined outside diameter between the roller shaft ends 72J. In the present embodiment, the outside diameter of each of the larger-diameter sections 71*a* of the first roller 71 is the same as the outside diameter of the second roller 72. The second roller 72 is made of a hard material, for example, metal or hard synthetic resin.

Next, the printer's operation of wiping the nozzle surface 63 will now be explained.

Figure 10:
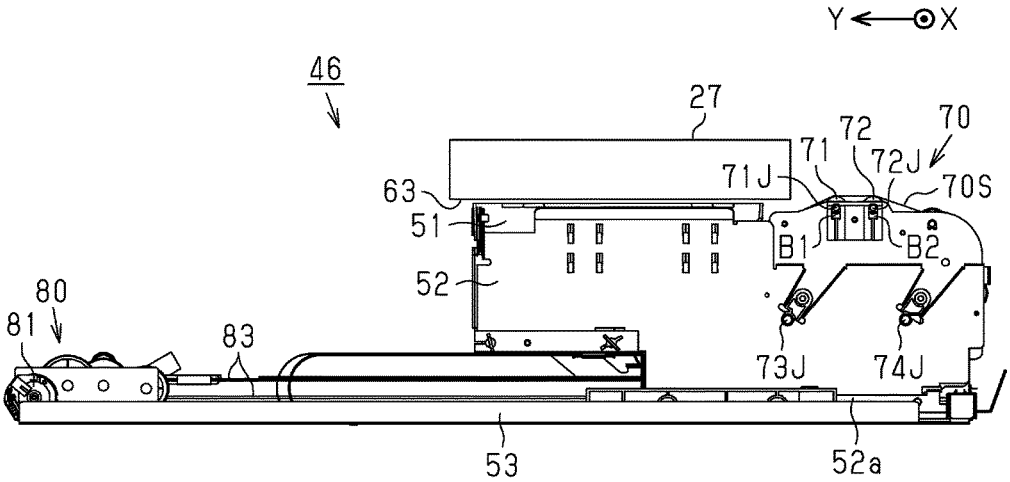
FIG. 10 is a side view of the wiper unit, illustrating a state of starting an operation for wiping a nozzle surface.

As illustrated in FIG. 10, in the printer 11, during printing on the recording target medium 13, the cassette holder 52 of the wiper unit 46 is in a standby state at its retracted position (which is the same as the position illustrated in FIG. 6). In the present embodiment, when the cassette holder 52 waits at the retracted position, the ink receiver cassette 51 for receiving ink ejected from the liquid ejecting head 27 (nozzles 26) is positioned at the scan area of the liquid ejecting head 27 (carriage 25). In the wiper cassette 70, the first wrapped-on region S1 and the second wrapped-on region S2 (see FIG. 9), which are pressed upward by the first roller 71 and the second roller 72 respectively to serve as the wiping part of the cloth sheet 70S, are located upstream of the scan area of the liquid ejecting head 27 in the transportation direction Y. The first wrapped-on region S1 and the second wrapped-on region S2 are arranged in this order as viewed toward the upstream side.

The printer 11 performs printing on the recording target medium 13 by alternately repeating recording operation and transportation operation, wherein, in the recording operation, an ink droplet is ejected from each nozzle 26 of the liquid ejecting head 27 onto the recording target medium 13 during the traveling of the carriage 25 in the scan direction X, and wherein, in the transportation operation, the recording target medium 13 is fed to the next recording position after the one-scan recording.

In the printer 11, head cleaning of forcibly sucking ink out of each liquid ejecting head 27 through the nozzles 26 is performed at the home position HP at predetermined timing (for example, at the timing of replacement of the ink cartridge 30, in the event of occurrence of faulty ink ejection from the nozzles 26, before printing, etc.). Of the nozzle surface 63 of the liquid ejecting head 27, the area corresponding to the inside of the cap 47 is wet with ink due to head cleaning. Therefore, wiping operation (cleaning operation) of wiping the nozzle surface 63 by means of the wiper cassette 70 (wiping it with the cloth sheet 70S) of the wiper unit 46 is performed in order to remove the ink. Since the nozzle-opening face 61, more particularly, the nozzle neighborhood area 62 (see FIG. 5), is coated with the liquid-repellent film 66, fine ink droplets on the nozzle neighborhood area (fine ink droplets smaller than the level difference 65 of 0.1 mm) flow when the cap 47 is released from the liquid ejecting head 27. Therefore, comparatively large ink droplets (ink droplets larger than the level difference 65 of 0.1 mm) remain on the nozzle neighborhood area 62.

To cause the nozzle surface 63 that is in such a state to be wiped by the wiper cassette 70 (with the cloth sheet 70S), first, the carriage motor 24 is operated to move the carriage 25 to the position where the nozzle surface 63 of the liquid ejecting head 27 is to be wiped by the wiper cassette 70.

Figure 11:
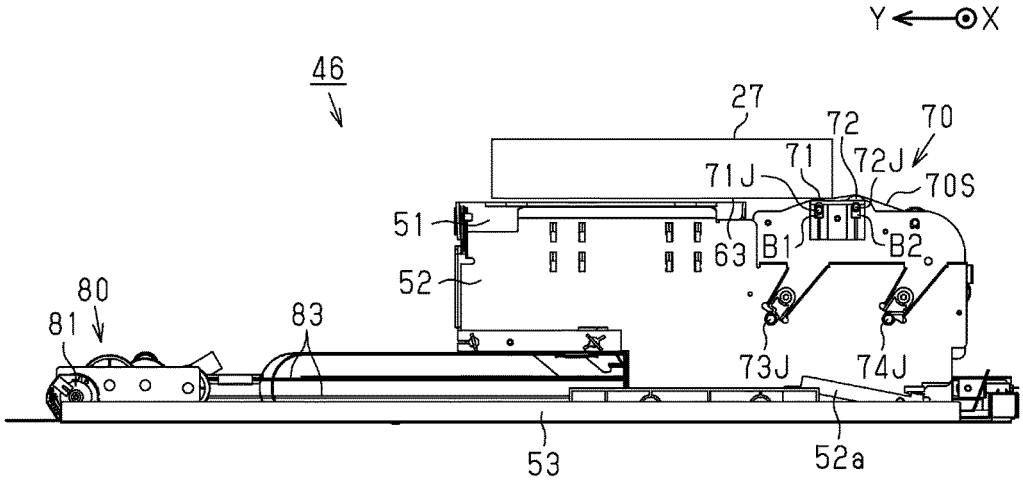
FIG. 11 is a side view of the wiper unit, illustrating a state of wiping the nozzle surface in the first contact.
Figure 12:
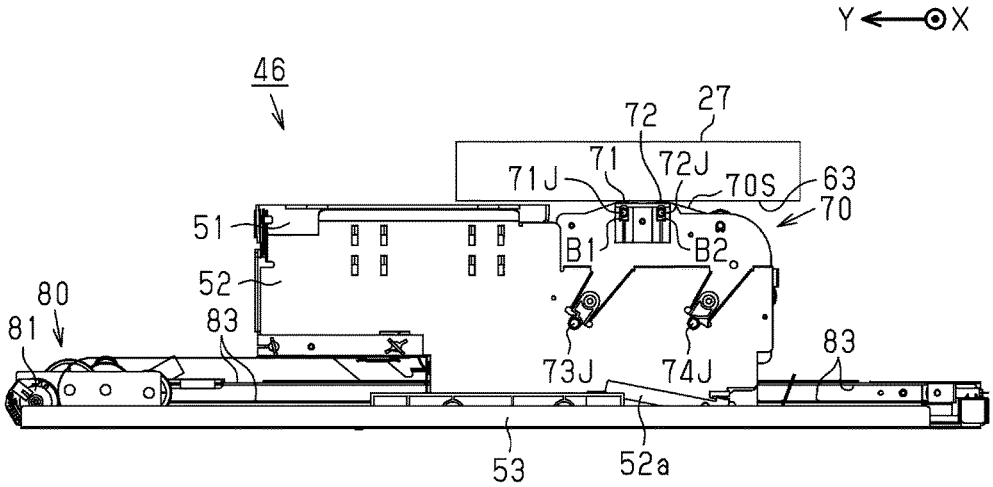
FIG. 12 is a side view of the wiper unit, illustrating a state of wiping the nozzle surface in the first contact and the second contact.
Figure 13:
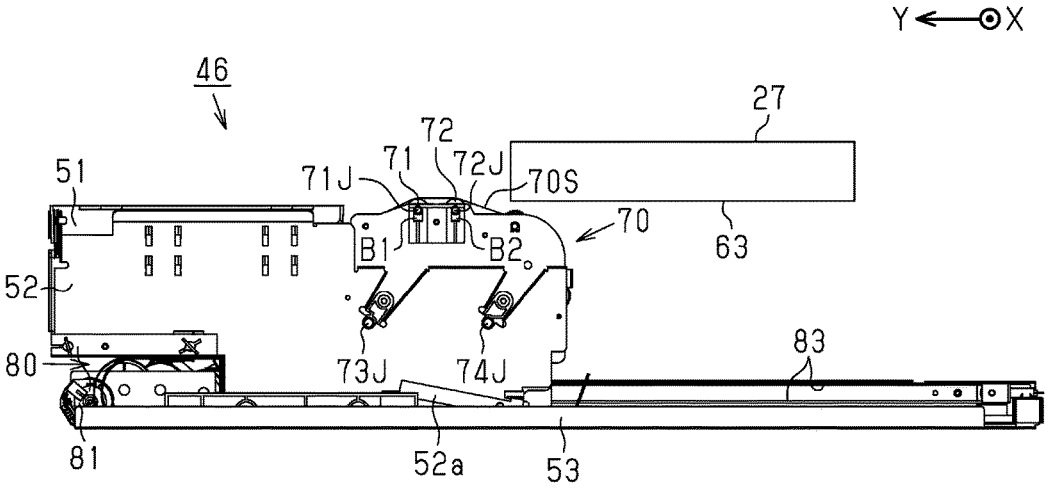
FIG. 13 is a side view of the wiper unit, illustrating a state of completion of the operation for wiping the nozzle surface.

Next, as illustrated in FIGS. 11, 12, and 13, the holder driver 80 of the wiper unit 46 is operated to move the cassette holder 52 from the retracted position in the transportation direction Y. Due to the movement, the nozzle surface 63 of the liquid ejecting head 27 is wiped with the cloth sheet 70S. The operation of wiping it with the cloth sheet 70S will now be explained in order.

Because of the movement of the cassette holder 52 of the wiper unit 46 from the retracted position, as illustrated in FIG. 11, first, the first roller 71, the roller shaft ends 71J of which are pushed upward by the compression springs B1, presses the cloth sheet 70S of the wiper cassette 70 against the nozzle surface 63 from an opposite side that is opposite of a side of contact with the nozzle surface 63. Pressed by the first roller 71, the first wrapped-on region S1 of the cloth sheet 70S of the wiper cassette 70 is held in contact with the nozzle surface 63. This contact is hereinafter referred to as "first contact". Therefore, the first roller 71 functions as an example of a first contacting section configured to perform the first contact.

Figure 14:
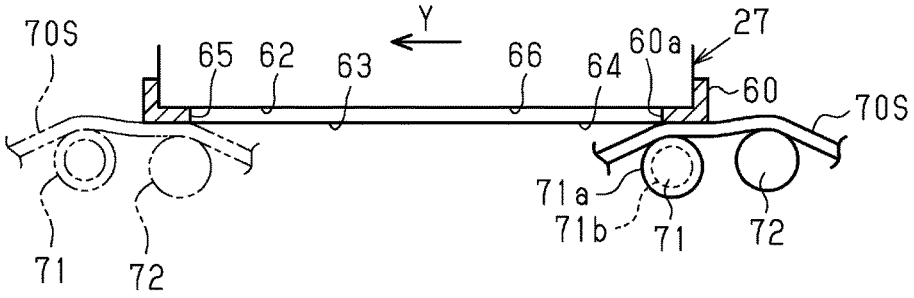
FIG. 14 is a schematic side view of a state of wiping the nozzle surface with the cloth sheet of the wiper cassette.
Figure 15:
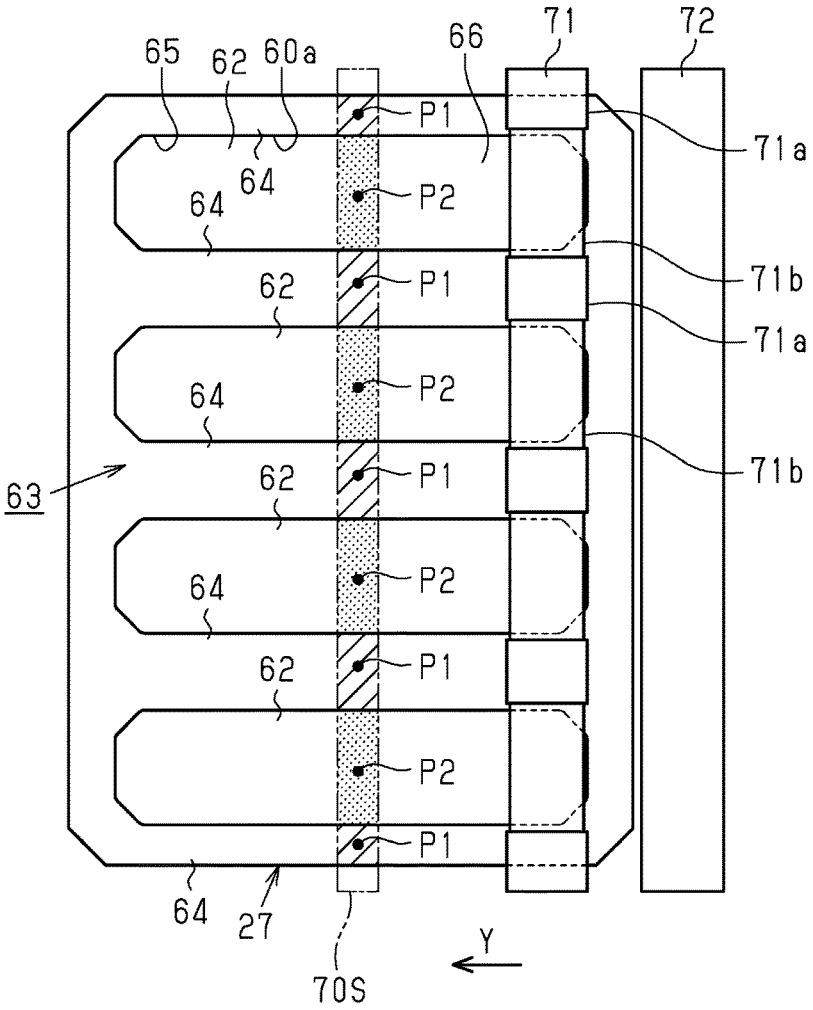
FIG. 15 is a schematic plan view of the state illustrated in FIG. 14, taken from the nozzle-surface side.

As illustrated in FIGS. 14 and 15, in the first contact, the cloth sheet 70S (first wrapped-on region S1) is pressed against the raised surface 64 by the larger-diameter sections 71*a* of the first roller 71 to produce the region of contact of the cloth sheet 70S with the raised surface 64 as indicated by each hatched area in FIG. 15. In addition, the cloth sheet 70S is pressed by the smaller-diameter sections 71*b* of the first roller 71 at the nozzle neighborhood areas 62 to produce the region of the cloth sheet 70S at the nozzle neighborhood area 62 as indicated by each dotted shade area in FIG. 15. Therefore, in the first contact, the coefficient of compressibility P2 of the region of the cloth sheet 70S at the nozzle neighborhood area 62 is smaller than the coefficient of compressibility P1 of the contact region of the cloth sheet 70S pressed against the raised surface 64 (nozzle non-neighborhood area). In a state in which the cloth sheet 70S is pressed with the coefficient of compressibility P1 at the contact region and the coefficient of compressibility P2 at the region each as enclosed by the dot-dot-dash line in FIG. 15, the cloth sheet 70S moves in the transportation direction Y, which is the wiping direction, as indicated by the solid line and the dot-dot-dash line in FIG. 14. As a result, ink on the nozzle surface 63 is wiped with the cloth sheet 70S.

In the present embodiment, the region of contact of the cloth sheet 70S with the nozzle surface 63 in the first contact, that is, an example of a first contact area, includes at least a part of the first wrapped-on region S1 and has a predetermined width in the transportation direction Y across the circumferential top of the first roller 71 in the vertical direction Z. In FIG. 15, the cloth sheet 70S is not illustrated.

Figure 16:
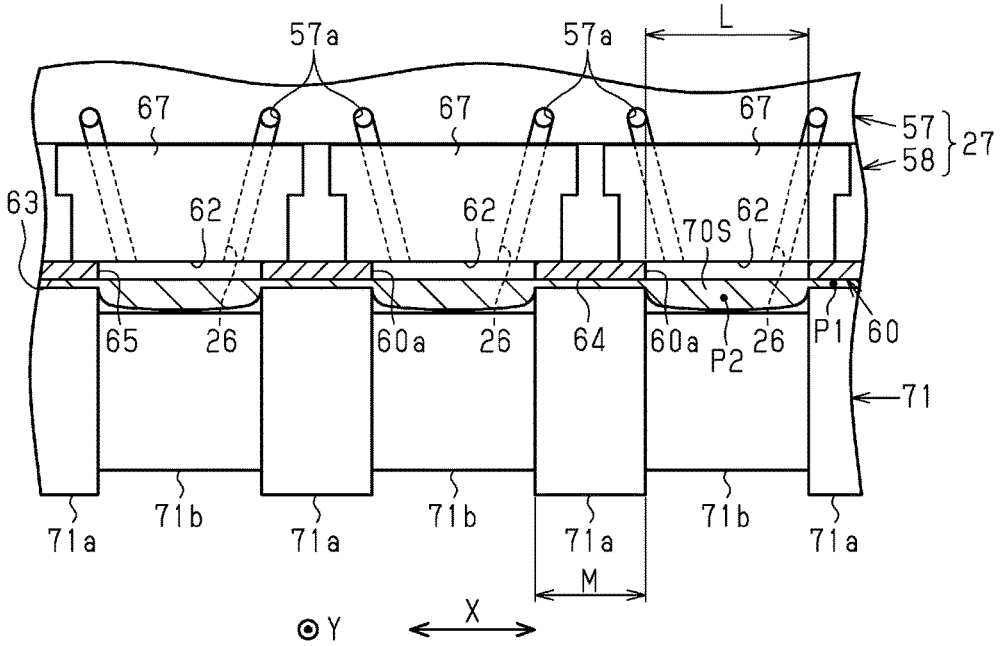
FIG. 16 is a schematic diagram that illustrates a state of wiping the nozzle surface with the cloth sheet in the first contact.

As illustrated in FIG. 16, in the first contact, since the smaller-diameter sections 71*b* of the first roller 71 correspond to the through-hole windows 60*a*, in this state, almost no pressing (compression) by the first roller 71 acts on each part of the cloth sheet 70S corresponding to the nozzle neighborhood area 62. Therefore, the coefficient of compressibility P2 of the region of the cloth sheet 70S at the nozzle neighborhood area 62 is zero or almost zero, meaning that the cloth sheet 70S is in contact with the nozzle surface 63 in a state of non-contact with the nozzle neighborhood area 62. Even though the cloth sheet 70S is not in contact with the nozzle neighborhood area 62, since an ink droplet on the nozzle neighborhood area 62 will probably be greater in size than the level difference 65 (0.1 mm), the cloth sheet 70S comes into contact with the ink droplet on the nozzle neighborhood area 62. Therefore, in the first contact, the cloth sheet 70S is able to absorb, and thus remove, the ink droplet on the nozzle neighborhood area 62 without any contact with the nozzle neighborhood area 62.

Ink absorbed by the cloth sheet 70S with which the nozzle surface 63 is wiped contains pigment particles as an inorganic substance. Therefore, if the cloth sheet 70S moves in the wiping process while being in contact under a strong pressing force at the nozzle neighborhood area 62, the pigment particles might function as abrasive grains to cause a damage at the nozzle neighborhood area 62. If liquid repellency at the nozzle neighborhood area 62 decreases as a result of accumulation of repetitive damages, it might induce a non-straight traveling of an ejected ink droplet in the air, resulting in poor print image quality.

In this respect, in the present embodiment, the nozzle surface 63 is wiped with the cloth sheet 70S with lower pressure at the nozzle neighborhood area 62 in comparison with pressure applied to the raised surface 64 in the first contact as illustrated in FIG. 16. Therefore, even if the wiping of the nozzle surface 63 with the cloth sheet 70S in the first contact is repeated, the structure of the present embodiment prevents the cloth sheet 70S from being pressed to the inside of the through-hole window 60*a* with a strong pressing force, making it less likely that liquid repellency at the nozzle neighborhood area 62 decreases. This reduces the possibility of the occurrence of a phenomenon of non-straight traveling of an ink droplet ejected from each nozzle 26 during printing. As a result, it is possible to offer excellent print image quality for a comparatively long period of time.

As illustrated in FIG. 16, the width M of the larger-diameter section 71*a* as viewed in the direction along the nozzle surface 63 intersecting with the direction of relative movement of the cloth sheet 70S in relation to the liquid ejecting head 27 while being in held in contact with the nozzle surface 63 is less than the width L of the nozzle neighborhood area 62 in said intersecting direction along the nozzle surface 63. In other words, the width M of the larger-diameter section 71*a* in the scan direction X orthogonal to the transportation direction Y, in which the cloth sheet 70S moves in the process of wiping the nozzle surface 63, is less than the width L of the nozzle neighborhood area 62 in the scan direction X.

Moreover, in the present embodiment, the width of the through-hole window 60*a* in the scan direction X, that is, the width L of the nozzle neighborhood area 62 in the scan direction X, is substantially equal to the width of the smaller-diameter section 71*b* of the first roller 71 in the scan direction X. For example, in the present embodiment, the width L of the nozzle neighborhood area 62 in the scan direction X is 6.58 mm.

Moreover, of the cover member 60, the width of each part of the raised surface 64 between two adjacent nozzle neighborhood areas 62 in the scan direction X, that is, the interval between two adjacent nozzle neighborhood areas 62, is substantially equal to the width M of the larger-diameter section 71*a* in the scan direction X. Therefore, the five larger-diameter sections 71*a* of the first roller 71 are arranged in the scan direction X at intervals substantially equal to the width L of the nozzle neighborhood area 62 in the scan direction X, and the four nozzle neighborhood areas 62 are arranged in the scan direction X at intervals substantially equal to the width M of the larger-diameter section 71*a* in the scan direction X.

Next, as illustrated in FIG. 12, because of the further movement of the cassette holder 52 of the wiper unit 46, the second roller 72, the roller shaft ends 72J of which are pushed upward by the compression springs B2, presses the cloth sheet 70S of the wiper cassette 70 against the nozzle surface 63 from an opposite side that is opposite of a side of contact with the nozzle surface 63 after the first contact by the first roller 71. Pressed by the second roller 72, the second wrapped-on region S2 of the cloth sheet 70S of the wiper cassette 70 is held in contact with the nozzle surface 63. This contact is hereinafter referred to as "second contact". Therefore, the second roller 72 functions as an example of a second contacting section configured to perform the second contact.

Figure 17:
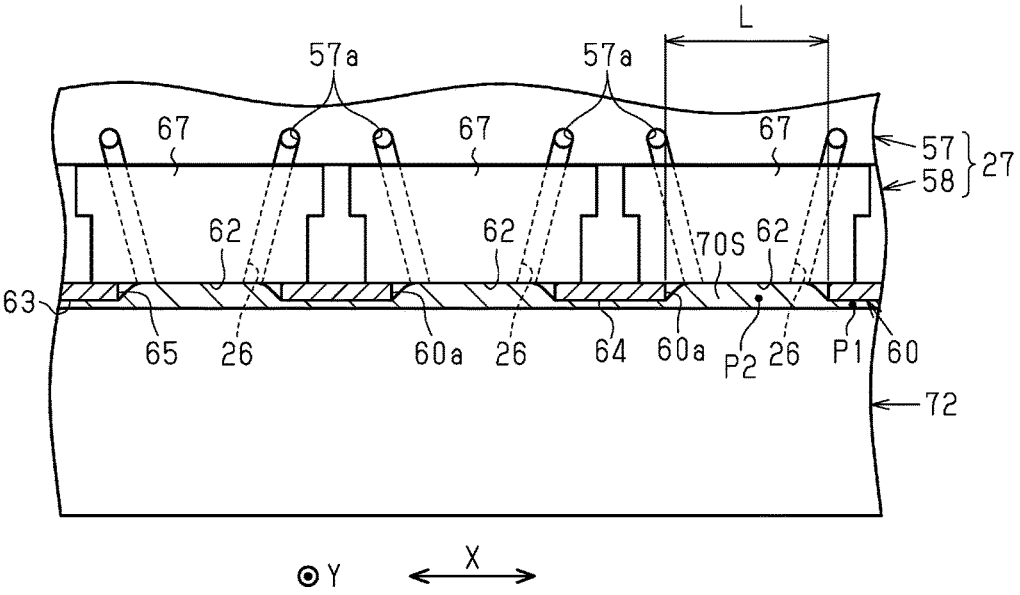
FIG. 17 is a schematic diagram that illustrates a state of wiping the nozzle surface with the cloth sheet in the second contact.

As illustrated in FIG. 17, in the second contact, the cloth sheet 70S (second wrapped-on region S2) is pressed by the outer circumferential surface of the second roller 72 against the raised surface 64 of the nozzle surface 63 and against the nozzle neighborhood areas 62 of the nozzle surface 63. In the second contact, because of the existence of the level difference 65, the coefficient of compressibility P2 of the contact region of the cloth sheet 70S pressed against the nozzle neighborhood area 62 is smaller than the coefficient of compressibility P1 of the contact region of the cloth sheet 70S pressed against the raised surface 64 (nozzle non-neighborhood area). In a state in which the cloth sheet 70S is pressed with the coefficient of compressibility P1 and the coefficient of compressibility P2 each in the second contact, the cloth sheet 70S moves in the transportation direction Y, which is the wiping direction, as indicated by the solid line and the dot-dot-dash line in FIG. 14. As a result, ink on the nozzle surface 63 is wiped with the cloth sheet 70S.

Though its illustration is omitted, the region of contact of the cloth sheet 70S with the nozzle surface 63 in the second contact, that is, an example of a second contact area, includes at least a part of the second wrapped-on region S2 and has a predetermined width in the transportation direction Y across the circumferential top of the second roller 72 in the vertical direction Z.

In the present embodiment, the coefficient of compressibility P2 of the contact region of the cloth sheet 70S pressed against the nozzle neighborhood area 62 in the second contact is larger than the coefficient of compressibility P2 in the first contact. That is, the second roller 72 is a non-recessed cylindrical roller that has "larger-diameter section 71*a*" only, meaning that there is no concave portion (smaller-diameter section 71*b*) at the position corresponding to each nozzle neighborhood area 62, unlike the first roller 71. Therefore, the pressure applied to the nozzle neighborhood area 62 by the second roller 72 due to the second contact of the cloth sheet 70S is higher than the pressure applied to the nozzle neighborhood area 62 by the first roller 71 due to the first contact of the cloth sheet 70S. Accordingly, in the second contact, the nozzle neighborhood area 62 is wiped with the cloth sheet 70S at pressure higher than that in the first contact. For this reason, fine ink droplets remaining on the nozzle neighborhood area 62 without having been absorbed during the first contact are wiped away with the cloth sheet 70S during the second contact. That is, the finish wiping of the nozzle surface 63 is performed as a result of the second contact.

The coefficient of compressibility P1 of the contact region of the cloth sheet 70S pressed against the raised surface 64 (nozzle non-neighborhood area) in the second contact is large, similarly to a large coefficient of compressibility in the first contact. Ink on the raised surface 64, which has lower repellency to liquid ink as compared with each nozzle neighborhood area 62, is more likely to wet-spread. Since ink having spread on the raised surface 64 is wiped with the cloth sheet 70S with a large coefficient of compressibility twice successively, effective absorption by the cloth sheet 70S is ensured. In the present embodiment, the amount of compression of the cloth sheet 70S having a thickness of 0.34 to 0.41 mm is 0.07 to 0.08 mm when the cloth sheet 70S is pressed against the raised surface 64 by the first roller 71 and the second roller 72 each. Accordingly, in the present embodiment, the thickness of the cloth sheet 70S during the wiping of the raised surface 64 with it is 0.26 to 0.34 mm.

Next, as illustrated in FIG. 13, the cassette holder 52 of the wiper unit 46 arrives at its going movement end position. This ends the wiping of the nozzle surface 63 with the cloth sheet 70S by the first roller 71 of the wiper cassette 70 due to the first contact and the wiping of the nozzle surface 63 with the cloth sheet 70S by the second roller 72 of the wiper cassette 70 due to the second contact after the first contact. Through the going movement described above, the ink on the nozzle surface 63 is wiped away with the cloth sheet 70S.

Figure 18:
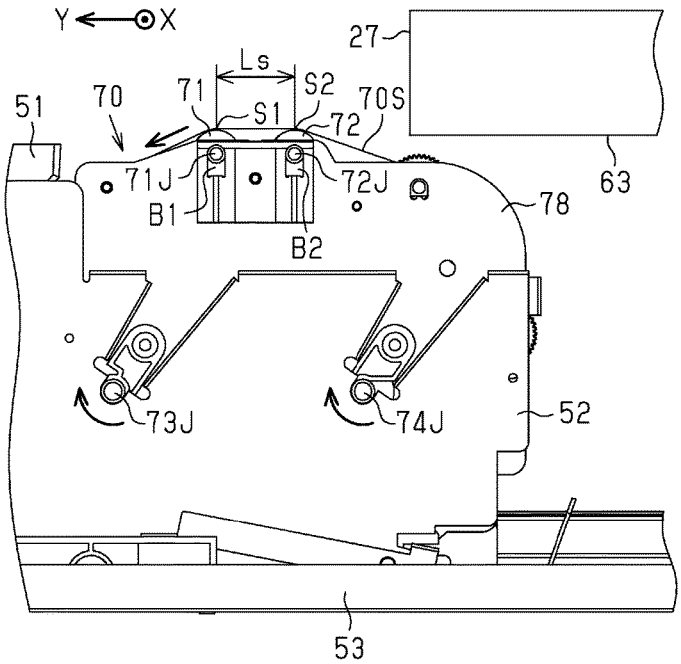
FIG. 18 is a side view of the wiper cassette, illustrating an operation of reeling the cloth sheet after the wiping.

As illustrated in FIG. 18, in the present embodiment, in a state in which the cassette holder 52 is located at the going movement end position, the operation of reeling the cloth sheet 70S of the wiper cassette 70 is performed. The rotation of the electric motor 91 (see FIG. 6) is controlled to reel the cloth sheet 70S by a predetermined length. Specifically, as indicated by arrows in FIG. 18, the roller shaft ends 74J of the unreeling roller 74 and the roller shaft ends 73J of the reeling roller 73 rotate to unreel the cloth sheet 70S, which is an example of a belt-shaped member, from the unreeling roller 74, which is an example of a supplying section. First, the cloth sheet 70S is supplied to the second contact area where the second contact is performed. After that, the cloth sheet 70S is supplied to the first contact area where the first contact is performed. Finally, the cloth sheet 70S is reeled onto the reeling roller 73, which is an example of a collecting section. The reeling onto the reeling roller 73 is referred to as collection herein.

In the present embodiment, in the operation of reeling the cloth sheet 70S, the cloth sheet 70S is unreeled and supplied from the unreeling roller 74 in such a way as to bring the second contact area part, which is the sheet's region that was in contact with the nozzle surface 63 in the second contact, to a position for contact with the nozzle surface 63 in the first contact. In the present embodiment, the cloth sheet 70S is reeled by a length Ls that brings the area part in the second wrapped-on region S2 corresponding to the circumferential top part of the second roller 72 in the vertical direction Z to a position of the area part in the first wrapped-on region S1 corresponding to the circumferential top part of the first roller 71 in the vertical direction Z. Therefore, the second contact area (region), which includes at least a part of the second wrapped-on region S2, and the first contact area (region), which includes at least a part of the first wrapped-on region S1, share a common region of contact.

In the present embodiment, during the operation of reeling the cloth sheet 70S, the carriage 25 (see FIG. 2) is moved in the scan direction X away from the position where the nozzle surface 63 of the liquid ejecting head 27 is to be wiped by the wiper cassette 70. Then, in the wiper unit 46, after the completion of wiping by the wiper cassette 70, the electric motor 81 is driven in the reverse direction. The reverse rotation causes coming-back movement for returning the cassette holder 52 from the going movement end position toward the retracted position illustrated in FIG. 6 in the wiper unit 46.

The exemplary embodiment described above in detail produces, for example, the following effects.

(1) Before the second contact, in which pressure for finish wiping is to be applied to the nozzle neighborhood area 62, the first contact is performed, wherein pressure that is lower than pressure applied to the nozzle neighborhood area 62 in the second contact is applied to the nozzle neighborhood area 62 in the first contact. Therefore, it is possible to catch a foreign object and/or an inorganic substance in ink, thereby reducing the deterioration of the nozzle surface 63.

(2) By using the first roller 71, which is an example of a first contacting section and is different from a second contacting section such as the second roller 72, it is possible to perform the first contact of applying pressure that is lower than pressure applied in the second contact.

(3) The first roller 71 is suitable as an example of a first contacting section because the smaller-diameter section 71*b* functioning as an example of a concave portion easily achieves a reduction in pressure applied to the nozzle neighborhood area 62 in the first contact.

(4) Since the pressure applied to the nozzle neighborhood area 62 is low, when the cloth sheet 70S functioning as an example of an absorption member is in contact with the nozzle surface 63 to absorb ink, it is possible to absorb the ink on the nozzle surface 63 while suppressing the damage to the nozzle neighborhood area 62.

(5) Since the coefficient of compressibility P2 of the regional part of the cloth sheet 70S pressed against the nozzle neighborhood area 62 is smaller than the coefficient of compressibility P1 of the regional part of the cloth sheet 70S pressed against the area other than the nozzle neighborhood area 62, pressure is adjusted properly depending on a difference between the regions of the cloth sheet 70S pressed against the nozzle surface 63. Therefore, it is possible to absorb the ink on the nozzle surface 63 while suppressing the damage to the nozzle neighborhood area 62 during the contact of the cloth sheet 70S.

(6) Even if the cloth sheet 70S is not in contact with the nozzle neighborhood area 62 during the first contact, the cloth sheet 70S is able to absorb ink (containing pigment as an inorganic substance) on the nozzle neighborhood area 62 or an ink meniscus protruding from the nozzle 26 by coming into contact with the ink. Therefore, it is possible to absorb the ink while suppressing the damage to the nozzle neighborhood area 62.

(7) Because of the wet-spreading of ink on the raised surface 64, the liquid repellency of which is relatively low, the cloth sheet 70S is able to absorb the ink on the raised surface 64 efficiently.

(8) The common cloth sheet 70S is used for the first contact and the second contact, resulting in efficiency in use of the cloth sheet 70S.

(9) Since the contact region of the cloth sheet 70S that was used for contact with the nozzle surface 63 in the second contact is reused in the next first contact, it is possible to reduce the amount of use of the cloth sheet 70S.

The exemplary embodiment described above may be modified as follows.

In the exemplary embodiment described above, the wiper cassette 70 may include a tension roller that applies tension to the cloth sheet 70S by pressing the part of the cloth sheet 70S between the first roller 71 and the second roller 72 away from the nozzle surface 63 from the side where the nozzle surface 63 is located.

Figure 19:
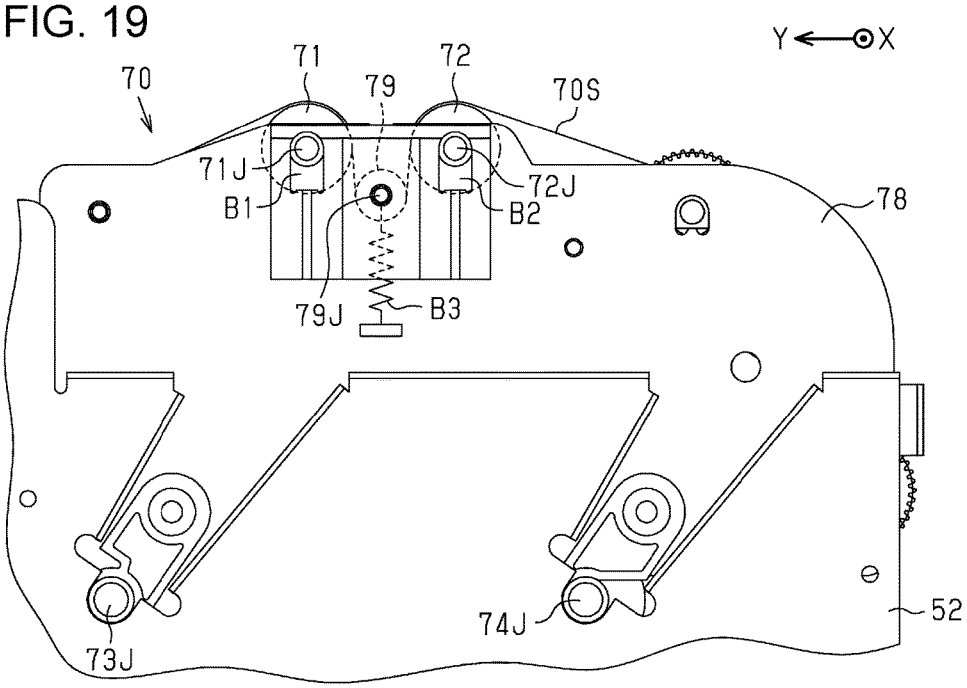
FIG. 19 is a side view of a variation example of the structure of the wiper cassette.

As illustrated in FIG. 19, in this variation example, a tension roller 79 for applying a force to the cloth sheet 70S in a direction of tightening the wrap of the cloth sheet 70S onto the first roller 71 and the second roller 72 each is provided between the first roller 71 and the second roller 72. The tension roller 79 is pulled downward, which is the direction of going away from the nozzle surface 63, by tension springs B3, one end of each of which is connected to the corresponding one of the roller shaft ends 79J of the tension roller 79 and the other end of each of which is fixed.

The wiper cassette 70 including the tension roller 79 according to this variation example makes it possible to, by adjusting the tensile force of the tension springs B3 pulling the tension roller 79, adjust the pressure of the cloth sheet 70S against the nozzle surface 63 (nozzle neighborhood area 62) by the first roller 71 in the first contact and adjust the coefficient of compressibility of the cloth sheet 70S. In addition, it is possible to adjust the pressure of the cloth sheet 70S against the nozzle surface 63 (nozzle neighborhood area 62) by the second roller 72 in the second contact and adjust the coefficient of compressibility of the cloth sheet 70S.

In the exemplary embodiment described above, it is not always necessary to provide the first roller 71, which is configured to perform the first contact, and the second roller 72, which is configured to perform the second contact. For example, a single contact member may be provided instead, wherein the single contact member has a cylindrical shape section that forms the first wrapped-on region S1 by being in contact with the cloth sheet 70S and a cylindrical shape section that forms the second wrapped-on region S2 by being in contact with the cloth sheet 70S, and wherein the cloth sheet 70S is pressed against the nozzle surface 63 from an opposite side that is opposite of a side of contact with the nozzle surface 63. In this case, the contact member is urged by an urging member (e.g., compression spring) adjusted in such a manner that the force of pressing the cloth sheet 70S by the cylindrical shape section that forms the first wrapped-on region S1 is weaker than the force of pressing the cloth sheet 70S by the cylindrical shape section that forms the second wrapped-on region S2.

In the exemplary embodiment described above, it is not always necessary that the first roller 71 have a concave portion that is recessed away from the cloth sheet 70S at each section corresponding to the nozzle neighborhood area 62 in comparison with each section corresponding to the area other than the nozzle neighborhood area 62. That is, the first roller 71 may be a non-recessed cylindrical roller that has the same shape as the shape of the second roller 72. In this case, the compression force of the compression spring B1 may be designed to be weaker than the compression force of the compression spring B2, thereby ensuring that the pressure applied to the nozzle neighborhood area 62 due to the contact of the cloth sheet 70S in the first contact is lower than the pressure applied to the nozzle neighborhood area 62 due to the contact of the cloth sheet 70S in the second contact.

Alternatively, the first roller 71 may be a non-recessed cylindrical roller that has a smaller diameter to ensure non-contact of the wrapped-on part of the cloth sheet 70S on the first roller 71 with the nozzle surface 63, and the tension of the cloth sheet 70S between the first roller 71 and the second roller 72 may be decreased so that the cloth sheet 70S will slightly bulge toward the nozzle surface 63, and the cloth sheet 70S that is in such a bulged state may be brought into contact with the nozzle surface 63 to perform the first contact. Similarly to the foregoing embodiment, this variation example makes it possible to make the pressure applied to the nozzle neighborhood area 62 due to the contact of the cloth sheet 70S in the first contact lower than the pressure applied to the nozzle neighborhood area 62 due to the contact of the cloth sheet 70S in the second contact by the second roller 72.

In the exemplary embodiment described above, it is not always necessary that, in the first contact, the pressure applied to the nozzle neighborhood area 62 of the nozzle surface 63 due to the contact of the cloth sheet 70S be lower than the pressure applied to the area other than the nozzle neighborhood area 62 of the nozzle surface 63 due to the contact of the cloth sheet 70S. For example, the former pressure may be equal to the latter pressure. In such a case, the first contact may be performed with a decreased (weakened) force of pressing the cloth sheet 70S by the first roller 71 by, for example, setting the compression force of the compression spring B1 to be weaker than the compression force of the compression spring B2.

In the exemplary embodiment described above, it is not always necessary that, in the first contact, the coefficient of compressibility P2 of the regional part of the cloth sheet 70S pressed against the nozzle neighborhood area 62 be smaller than the coefficient of compressibility P1 of the regional part of the cloth sheet 70S pressed against the area other than the nozzle neighborhood area 62. For example, the value of the coefficient of compressibility P2 may be the same as the value of the coefficient of compressibility P1. In such a case, the first contact may be performed with a decreased (weakened) force of pressing the cloth sheet 70S by the first roller 71 by, for example, setting the compression force of the compression spring B1 to be weaker than the compression force of the compression spring B2.

In the exemplary embodiment described above, in the first contact, the cloth sheet 70S may be in contact with the nozzle surface 63 in a state of contact with the nozzle neighborhood area 62. In such a case, in order to prevent a strong force from being applied to the nozzle neighborhood area 62 due to the contact of the cloth sheet 70S with the nozzle neighborhood area 62, that is, in order to avoid a large force of pressing the cloth sheet 70S, for example, preferably, the compression force of the compression spring B1 should be small to suppress the force of pressing the cloth sheet 70S.

In the exemplary embodiment described above, instead of providing the raised surface 64, a treatment for liquid repellency may be applied to the area that is located in the neighborhood of the orifices of the nozzles 26 of the nozzle-opening face 61 (area corresponding to the nozzle neighborhood area 62 in the exemplary embodiment described above) without applying a treatment for liquid repellency to the area (area corresponding to the nozzle non-neighborhood area in the exemplary embodiment described above) located outside the liquid-repellent treated area. In this case, the nozzle-opening face 61 corresponds to the nozzle surface 63 that is the target of wiping with the cloth sheet 70S of the wiper cassette 70 in the exemplary embodiment described above.

In the exemplary embodiment described above, it is not always necessary that the liquid repellency of the raised surface 64 be lower than that of the nozzle neighborhood area 62. For example, the liquid repellency of the raised surface 64 may be equal to that of the nozzle neighborhood area 62.

In the exemplary embodiment described above, it is not always necessary that, in the wiper cassette 70, the cloth sheet 70S supplied from the unreeling roller 74 (supplying section) be collected onto the reeling roller 73 (collecting section). For example, the cloth sheet 70S may have a shape of an endless belt wrapped on at least the second roller 72 and the first roller 71 and may be configured to turn for repetition of the second contact and the first contact.

In the exemplary embodiment described above, it is not always necessary that the cloth sheet 70S be supplied in such a way as to bring the contact part that was in contact with the nozzle surface 63 in the second contact to a position for contact with the nozzle surface 63 in the first contact. For example, the cloth sheet 70S may be supplied in such a way as to bring the part of the cloth sheet 70S between the first-execution contact part of the cloth sheet 70S that was, in wiping operation, in contact with the nozzle surface 63 in the first-execution second contact and the second-execution contact part of the cloth sheet 70S that was in contact with the nozzle surface 63 in the second-execution second contact to a position for contact with the nozzle surface 63 in the first contact. In this case, preferably, the part of the cloth sheet 70S for contact with the nozzle surface 63 in the first contact should be a middle part between the first-execution contact part of the cloth sheet 70S and the second-execution contact part of the cloth sheet 70S.

In the exemplary embodiment described above, a yet-to-be-used cloth sheet 70S, with which the nozzle surface 63 has not been wiped yet, may have been impregnated in advance with a cleaning liquid (for example, water) for improving the performance of wiping the nozzle surface 63. Alternatively, a cleaning liquid may be applied before wiping the nozzle surface 63 with a yet-to-be-used cloth sheet 70S, instead of advance impregnation of the cloth sheet 70S with the cleaning liquid. In a case of cleaning liquid application before wiping, a cleaning liquid may be applied to the cloth sheet 70S in such a way that the first contact is to be performed in a state of containing the cleaning liquid and that the second contact is to be performed in a state of not containing the cleaning liquid.

In the exemplary embodiment described above, pressurized cleaning operation may be performed. In pressurized cleaning operation, the nozzle surface 63 is wiped by means of the wiper cassette 70 in a state in which ink bulges from the nozzle surface 63. That is, the nozzle surface 63 may be wiped due to the first contact while activating the supply pump 34 to pressurize the supply passage 33, through which ink is supplied from the ink cartridge 30 to the liquid ejecting head 27, thereby causing ink to bulge from the nozzle surface 63.

When such pressurized cleaning operation is performed, ink may be discharged through the nozzles 26 into the ink receiver cassette 51 in a state in which the cassette holder 52 is located at the retracted position. After that, the cassette holder 52 may be moved toward the downstream side in the transportation direction Y to perform the first contact by the first roller 71 and the second contact by the second roller 72, thereby wiping the nozzle surface 63 with the cloth sheet 70S.

In the exemplary embodiment described above, in the wiper unit 46, the ink receiver cassette 51 may be provided upstream of the wiper cassette 70 in the transportation direction Y. In this case, at the retracted position (which is the same as the position illustrated in FIG. 10) where the ink receiver cassette 51 is positioned at the scan area of the liquid ejecting head 27 (carriage 25), the first wrapped-on region S1 and the second wrapped-on region S2, which are pressed upward by the first roller 71 and the second roller 72 respectively to serve as the wiping part of the cloth sheet 70S, are located downstream of the scan area of the liquid ejecting head 27 in the transportation direction Y, and the first wrapped-on region S1 and the second wrapped-on region S2 are arranged in this order as viewed toward the downstream side. The holder driver 80 of the wiper unit 46 is operated to move the cassette holder 52 from the retracted position in the direction that is the opposite of the transportation direction Y (i.e., from the downstream side to the upstream side of the transportation direction), thereby wiping the nozzle surface 63 of the liquid ejecting head 27 with the cloth sheet 70S.

In the exemplary embodiment described above, after wiping the nozzle surface 63 with the cloth sheet 70S by moving the cassette holder 52 of the wiper unit 46 from the upstream side toward the downstream side in the transportation direction Y (going movement), the cassette holder 52 may be moved from the downstream side toward the upstream side in the transportation direction Y (coming-back movement) to wipe the nozzle surface 63 with the cloth sheet 70S. In this case, it follows that the nozzle surface 63 is wiped with the cloth sheet 70S in the first contact by the first roller 71 after having been wiped with the cloth sheet 70S in the second contact by the second roller 72.

In the exemplary embodiment described above, flushing of ejecting an ink droplet from each nozzle 26 may be performed into the ink receiver cassette 51. Alternatively, flushing may be performed onto the cloth sheet 70S. In a case where flushing is performed onto the cloth sheet 70S, the already-used region (the region with which nozzle surface 63 has been wiped) of the cloth sheet 70S may be used for the flushing.

In the exemplary embodiment described above, it is not always necessary that the width M of the larger-diameter section 71*a* in the scan direction X be less than the width L of the nozzle neighborhood area 62 in the scan direction X.

In the exemplary embodiment described above, the raised surface 64 may be formed integrally as a part of the liquid ejecting head 27 without providing the cover member 60. In such a case, the nozzle-opening face 61 is a partially-concave-and-partially-convex surface.

In the exemplary embodiment described above, the cleaning of the liquid ejecting head 27 may be performed while capping the nozzle line 59 on a line-by-line basis. This makes it possible to reduce cap size as compared with a case where head cleaning is performed while capping all of the plurality of nozzle lines 59 with the cap 47, thereby reducing the amount of ink consumption during head cleaning.

In the exemplary embodiment described above, instead of impregnating a yet-to-be-used cloth sheet 70S with a cleaning liquid in advance, a cleaning liquid applying mechanism such as an ejection nozzle may be provided, and the nozzle surface 63 may be wiped with the cloth sheet 70S after applying a cleaning liquid to the nozzle surface 63.

In the exemplary embodiment described above, the nozzle surface 63 may be wiped by means of the wiper cassette 70 by moving the nozzle surface 63 in relation to the wiper cassette 70 (cassette holder 52) that is stationary. Alternatively, the wiping may be performed by moving both the wiper cassette 70 and the nozzle surface 63.

In the exemplary embodiment described above, the ink-jet printer 11 may be a line-head-type printer that does not include the carriage 25 supporting the liquid ejecting head 27 and includes a line head whose print range encompasses the entire width of the recording target medium 13. In this case, since the line head is fixed and immovable, the nozzle surface 63 is wiped by moving the wiper cassette 70.

The printer 11 according to the exemplary embodiment described above has four nozzle neighborhood areas 62 corresponding to four recording heads 67 of the liquid ejecting head 27. However, the number of nozzle neighborhood areas 62, and the corresponding number of recording heads 67, is not limited to four. The printer 11 may have, for example, five or more nozzle neighborhood areas 62, the number of which corresponds to the number of recording heads 67.

The liquid ejecting apparatus according to the exemplary embodiment described above may eject and/or discharge other liquid that is not ink instead of ink. Examples of the state of a droplet outputted as an ultra-small amount of the liquid from the liquid ejecting apparatus are: a particulate droplet, a tear-shaped droplet, and a viscous droplet that forms a thread tail. The "liquid" mentioned herein may be made of any material as long as it can be ejected from the liquid ejecting apparatus. Any material whose substance is in the liquid phase can be used, for example: liquid that has high viscosity or low viscosity, sol or gel water, or other fluid such as inorganic solvent, organic solvent, solution, liquid resin, or liquid metal (metal melt), though not limited thereto. The liquid is not limited to liquid as a state of substance. It encompasses a liquid matter that is made as a result of dissolution, dispersion, or mixture of particles of a functional material made of a solid such as pigment, metal particles, or the like into/with a solvent, though not limited thereto. Typical examples of the liquid are: liquid crystal, various liquid compositions such as water-based ink, non-water-based ink, oil-based ink, gel ink, and hot melt ink, etc. A specific example of the liquid ejecting apparatus is: an apparatus that ejects liquid in which, for example, a material such as an electrode material, a color material, or the like that is used in the production of a liquid crystal display, an EL (electroluminescence) display, a surface emission display, a color filter, or the like is dispersed or dissolved. The liquid ejecting apparatus may be an apparatus that ejects a living organic material used for production of biochips, or is used as a high precision pipette and ejects a liquid sample, a textile printing apparatus, or a micro dispenser, etc. The liquid ejecting apparatus may be an apparatus that ejects, with high precision, lubricating oil onto precision equipment, for example, a watch or a camera. The liquid ejecting apparatus may be an apparatus that ejects liquid of a transparent resin such as an ultraviolet ray curing resin, etc. onto a substrate so as to form a micro hemispherical lens (optical lens) that is used in an optical communication element, etc. The liquid ejecting apparatus may be an apparatus that ejects an etchant such as acid or alkali that is used for the etching of a substrate, etc.

What is claimed is:

1. A liquid ejecting apparatus, comprising:

a liquid ejecting head that ejects liquid from a plurality of nozzles arranged in a nozzle surface;

an absorption member that is brought into contact with the nozzle surface and is able to absorb liquid that is on the nozzle surface; and a contacting section that performs a first contact of the absorption member with the nozzle surface and performs, after the first contact, a second contact of the absorption member with the nozzle surface by pressing the absorption member against the nozzle surface from an opposite side that is opposite of a side of contact with the nozzle surface, wherein pressure applied to, of the nozzle surface, a nozzle peripheral area including the nozzles due to contact of the absorption member in the first contact is lower than pressure applied to the nozzle peripheral area due to contact of the absorption member in the second contact, wherein the contacting section includes a first contacting section that performs the first contact by holding the absorption member in contact with the nozzle surface and a second contacting section that is different from the first contacting section and that performs the second contact by holding the absorption member in contact with the nozzle surface.

2. The liquid ejecting apparatus according to claim 1, wherein the first contacting section has a concave portion that is recessed away from the absorption member at a portion corresponding to the nozzle peripheral area in comparison with a portion corresponding to an area other than the nozzle peripheral area.

3. The liquid ejecting apparatus according to claim 1, wherein the pressure applied to the nozzle peripheral area of the nozzle surface due to the contact of the absorption member in the first contact is lower than pressure applied to an area other than the nozzle peripheral area of the nozzle surface due to the contact of the absorption member in the first contact.

4. The liquid ejecting apparatus according to claim 1, wherein a coefficient of compressibility of a portion of the absorption member pressed against the nozzle peripheral area in the first contact is smaller than a coefficient of compressibility of a portion of the absorption member pressed against the area other than the nozzle peripheral area in the first contact.

5. The liquid ejecting apparatus according to claim 1, wherein, in the first contact, the absorption member is in contact with the nozzle surface without any contact with the nozzle peripheral area.

6. The liquid ejecting apparatus according to claim 1, wherein an area other than the nozzle peripheral area is a raised surface that is higher in level than the nozzle peripheral area and has lower liquid repellency than liquid repellency of the nozzle peripheral area.

7. The liquid ejecting apparatus according to claim 1, wherein the absorption member is a belt-shaped member; and wherein the belt-shaped member is supplied from a supplying section to a second contact area where the second contact is performed, next from the second contact area to a first contact area where the first contact is performed, and next from the first contact area to a collecting section.

8. The liquid ejecting apparatus according to claim 7, wherein the absorption member is supplied in such a way as to bring a contact portion that was in contact with the nozzle surface in the second contact to a position for contact with the nozzle surface in the first contact.

9. A cleaning apparatus, comprising:

an absorption member that is brought into contact with a nozzle surface of a liquid ejecting head that ejects liquid from a plurality of nozzles arranged in the nozzle surface, and is able to absorb liquid that is on the nozzle surface; and a contacting section that performs a first contact of the absorption member with the nozzle surface and performs, after the first contact, a second contact of the absorption member with the nozzle surface by pressing the absorption member against the nozzle surface from an opposite side that is opposite of a side of contact with the nozzle surface, wherein pressure applied to, of the nozzle surface, a nozzle peripheral area including the nozzles due to contact of the absorption member in the first contact is lower than pressure applied to the nozzle peripheral area due to contact of the absorption member in the second contact, wherein the contacting section includes a first contacting section that performs the first contact by holding the absorption member in contact with the nozzle surface and a second contacting section that is different from the first contacting section and that performs the second contact by holding the absorption member in contact with the nozzle surface.

* * * * *